US007224930B2

(12) United States Patent
Oda et al.

(10) Patent No.: US 7,224,930 B2
(45) Date of Patent: May 29, 2007

(54) IMAGE FORMING APPARATUS

(75) Inventors: Yasuhiro Oda, Kanagawa (JP); Akihisa Maruyama, Kanagawa (JP); Miho Ikeda, Kanagawa (JP); Koichiro Yuasa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 123 days.

(21) Appl. No.: 11/208,892

(22) Filed: Aug. 23, 2005

(65) Prior Publication Data

US 2006/0182466 A1 Aug. 17, 2006

(30) Foreign Application Priority Data

Feb. 14, 2005 (JP) ..... P2005-035984

(51) Int. Cl.
*G03G 21/10* (2006.01)
*G03G 21/00* (2006.01)
*G03G 15/16* (2006.01)
*G03G 15/08* (2006.01)

(52) U.S. Cl. ..... 399/359; 399/98; 399/101; 399/253

(58) Field of Classification Search ..... 399/98, 399/99, 101, 253, 358, 359
See application file for complete search history.

(56) References Cited

U.S. PATENT DOCUMENTS 4,054,381 A * 10/1977 Bernhard ..... 399/359
4,389,968 A * 6/1983 Satomura ..... 399/359
5,481,351 A * 1/1996 Kawai et al. ..... 399/359
5,486,905 A * 1/1996 Takeda et al. ..... 399/253
5,555,469 A * 9/1996 Ishikawa et al. ..... 399/359 X
5,950,062 A * 9/1999 Yahata et al. ..... 399/358
6,157,807 A * 12/2000 Takenouchi et al. ..... 399/358
6,615,013 B2 * 9/2003 Arai et al. ..... 399/253
6,829,461 B2 * 12/2004 Arai et al. ..... 399/253

FOREIGN PATENT DOCUMENTS

JP A-05-313543 11/1993
JP A-6-282201 10/1994
JP A-62-144191 6/1997
JP A-2001-312132 11/2001

* cited by examiner

*Primary Examiner*—Sandra L. Brase
(74) *Attorney, Agent, or Firm*—Morgan, Lewis & Bockius LLP

(57) ABSTRACT

An image forming apparatus includes a latent-image carrier, a developing unit, a transfer unit, a cleaning unit, a recovered-toner supply unit, and a foreign-matter collecting unit. The developing unit carries a developer containing a toner and develops an electrostatic latent image on the latent-image carrier with the toner. The transfer unit transfers the toner developed on the latent-image carrier to a recording material directly or via an intermediate transfer body. The cleaning unit removes a toner remaining on at least one of the latent-image carrier and the intermediate transfer medium after the transfer. The recovered-toner supply unit supplies a toner removed by the cleaning unit to the developing unit again. The foreign-matter collecting unit collects a foreign matter, which is mixed into the toner supplied from the recovered-toner supply unit and moved onto the latent-image carrier by the developing unit, before the transfer by the transfer unit.

15 Claims, 11 Drawing Sheets

IMAGE FORMING APPARATUS

BACKGROUND OF THE INVENTION

1. Field of the Invention

The present invention relates to image forming apparatuses such as copying machines, printers, and facsimiles, and more particularly, to an image forming apparatus, which reuses (reclaims) toner recovered by a cleaner in image forming.

2. Description of the Related Art

As conventional image forming apparatuses, the following image forming apparatus has been widely used. The image forming apparatus is configured such that an electrostatic latent image is formed by exposing a uniformly charged surface of a photoconductor drum, the formed electrostatic latent image is developed and visualized with toner by a developing device, the developed image is transferred onto a sheet of paper, and a residual toner remaining on the photoconductor drum after the transfer is recovered by a cleaner.

In recent years, there have been demands for global environment conservation, and a reduction in the absolute amount of waste discharged from image forming apparatuses has been required. Thus, a recovered toner recycling method has been considered. According to this method, toner recovered by a cleaner after transfer is returned to a developing device and reused (reclaimed) therein.

Meanwhile, in addition to the above-described residual toner, foreign matters (for example, paper debris, etc. created from sheets of paper) reversely transferred onto the photoconductor drum from sheets of paper during transfer may be mixed into the recovered toner. Therefore, when the above-described recovered toner recycling method is employed, the foreign matters also may be carried into the developing device along with the recovered toner. If foreign matters are mixed into the toner within the developing device, the foreign matters and the toner form aggregates and the formed aggregates are moved to the photoconductor drum by developing operation. At this time, if the foreign matters have a charged polarity reverse to that of, for example, the toner, the aggregates, i.e., the foreign matters with the toner may be moved to a non-image portion of the photoconductor drum to cause spotted contamination. Therefore, image quality may deteriorate.

Further, in an image forming apparatus, which uses as a cleaner a cleaning member such as a blade member, coming into pressure contact with the photoconductor drum, a photosensitive layer formed on the photoconductor drum wears away with its use for an extended period of time. Then, if the wear of the photosensitive layer proceeds to some degrees, the charging performance of the photoconductor drum may deteriorate. As a result, image defects may occur such that fogging is caused due to transfer of the toner to the non-image portion.

Accordingly, a technique of suppressing wear of the photoconductor drum has been proposed (see JP 2001-312132 A (pages 5–8)). In this technique, a lubricant composed of metal stearate is contained in a developer, and the lubricant is supplied to the photoconductor drum to form a film composed of metal stearate on the surface of the photoconductor drum.

However, the lubricant supplied to the photoconductor drum does not become the film of the surface of the photoconductor drum in its entirety, but its large portion is removed by the cleaner. At this time, a portion of the lubricant is subjected to a stress. As a result the portion of the lubricant is aggregated and greatly enlarged at a pressure-contact portion between the photoconductor drum and the blade member. Therefore, when the above-described recovered toner recycling method is employed, the greatly enlarged toner along with the recovered toner may also be carried into the developing device. When the greatly enlarged lubricant is mixed into the toner within the developing device, similar to the above-described foreign matters such as paper debris, the greatly enlarged lubricant forms aggregates along with the toner, and the formed aggregates are moved to the photoconductor drum by developing operation. At this time, if the lubricant has a charged polarity reverse to that of, for example, the toner, the aggregates, i.e., the greatly enlarged lubricant with the toner may be moved to a non-image portion of the photoconductor drum to cause spotted contamination. Therefore, image quality may deteriorate.

Accordingly, a technique of removing foreign matters of a predetermined size or more has been proposed (for example see JP Sho.62-144191 (A pages 2–3 and FIG. 2)). In this technique, a mesh filter is provided on a path along which recovered toner is carried from the cleaner to the developing device. Further, another document discloses that a brush roller to which a predetermined bias is applied is provided on a path along which recovered toner is carried from the cleaner to the developing device and that talc carried along with the recovered toner is collected (see JP Hei.5-313543 A (pages 2–3 and FIG. 2)). Moreover, still another document discloses a technique of removing paper debris carried on a photoconductor drum after transfer along with waste toner (see JP Hei.6-282201 A (pages 3–5 and FIGS. 3–4)). In this technique, a brush member to which a predetermined bias is applied is located on downstream of a transfer position of an image to a sheet of paper and on upstream of a cleaning position by a cleaner so as to contact the photoconductor drum.

SUMMARY OF THE INVENTION

However, in JP Sho.62-144191 A, as the captured foreign matters increase, the mesh filter needs to be regularly replaced because the mesh filter is clogged up. Therefore, the cost required for replacement increases as well as the frequency of maintenance increases. Also, it is considered that a mechanism for preventing clogging of the mesh filter is additionally provided, but this may make the configuration of the apparatus complicated.

On the other hand, in JP Hei.5-313543 A and JP Hei.6-282201 A, when talc or paper debris is electrostatically collected, even inherently reusable toner may be collected together. In this case, since waste discharged from the image forming apparatus may increase, it is difficult to say that these techniques are effective countermeasures. In JP Hei.5-313543 A, since the upstream cleaner removes paper debris, if the lubricant described in JP 2001-312132 A is used, this technique cannot cope with the greatly enlarged lubricant created in the cleaner.

The invention has been made to address the concerned technical problems. The invention may reduce a bad influence on an image due to foreign matters collected along with toner recovered by a cleaner when the toner is reused for image forming, with a simple structure.

The invention also may reduces a bad influence on an image due to foreign matters collected along with toner recovered by a cleaner when the toner is reused for image forming, while enhancing the use efficiency of recovered toner.

According to one aspect of the invention, an image forming apparatus includes a latent-image carrier, a developing unit, a transfer unit, a cleaning unit, are covered-toner supply unit, and a foreign-matter collecting unit. The developing unit carries a developer containing a toner and develops an electrostatic latent image on the latent-image carrier with the toner. The transfer unit transfers the toner developed on the latent-image carrier by the developing unit to a recording material directly or via an intermediate transfer body. The cleaning unit removes a toner remaining on at least one of the latent-image carrier and the intermediate transfer medium after the transfer. The recovered-toner supply unit supplies a toner removed by the cleaning unit to the developing unit again. The foreign-matter collecting unit collects a foreign matter, which is mixed into the toner supplied from the recovered-toner supply unit and moved onto the latent-image carrier by the developing unit, before the transfer by the transfer unit.

According to another aspect of the invention, an image forming apparatus includes an image carrier, a developing section, a transfer section, a cleaning section, a recovered-toner supply section, a facing member, and a bias-applying section. The image carrier is rotatably disposed to carry an electrostatic latent image including a printed area and a non-printed area. The developing section develops the printed area of the electrostatic latent image carried on the image carrier with a toner. The transfer section transfers a toner developed on the image carrier by the developing section to a transfer material. The cleaning section removes a toner remaining on the image carrier after transferring the toner by the transfer section. The recovered-toner supply section supplies a toner removed by the cleaning section to the developing section again. The facing member is disposed on downstream of the developing section in a rotation direction of the image carrier and on upstream of the transfer section in the rotation direction of the image carrier to face the image carrier in non-contact therewith. The bias-applying section that applies a bias for forming an electric field between the image carrier and the facing member. The electric field moves a foreign matter attached to the non-printed area of the electrostatic latent image of the image carrier to the facing member.

According to still another aspect of the invention, an image forming apparatus includes a black-image forming unit, at least one color-image forming unit, an intermediate transfer body, a secondary transfer section, and an intermediate-transfer cleaning section. The black-image forming unit forms a black toner image. The at least one color-image forming unit forms a color toner image other than the black toner image. The intermediate transfer body circulates between a position facing the black-image forming unit and a position facing the color-image forming unit. The toner image formed by the black-image forming unit and/or the color-image forming unit is primarily transferred onto the intermediate transfer body. The secondary transfer section secondarily transfers the toner images primarily transferred on to the intermediate transfer medium on to a recording material. The intermediate-transfer cleaning section removes a toner remaining on the intermediate transfer body after the secondary transfer. Each of the black-image forming unit and the color-image forming unit includes an image carrier, a developing section, and a primary transfer section. The image carrier is rotatably disposed to carry an electrostatic latent image. The developing section develops the electrostatic latent image carried on the image carrier with the toner of a corresponding color. The primary transfer section transfers the toner developed on the image carrier by the developing section onto the intermediate transfer body. The developing section of the black-image forming unit is supplied with the toner removed by the intermediate-transfer cleaning section. The black-image forming unit further includes a foreign-matter collecting section that collects a foreign matter, which is mixed into the toner to be supplied to the developing section via the intermediate-transfer cleaning section and moved to the image carrier from the developing section, before the transfer by the primary transfer section.

According to the structures described above, a foreign matter moved to the latent-image carrier by development is collected before transfer. Therefore, in a case where the toner is reused for image forming, a bad influence on an image due to foreign matters collected along with toner recovered by a cleaner can be reduced with a simple structure.

BRIEF DESCRIPTION OF THE DRAWINGS

Embodiment of the invention will be described in detail based on the following figures, wherein.

DETAILED DESCRIPTION OF THE EMBODIMENTS

Hereinafter, a best mode for carrying out the invention (hereinafter, referred to as embodiment) will be described in detail with reference to the accompanying drawings.

Figure 1:
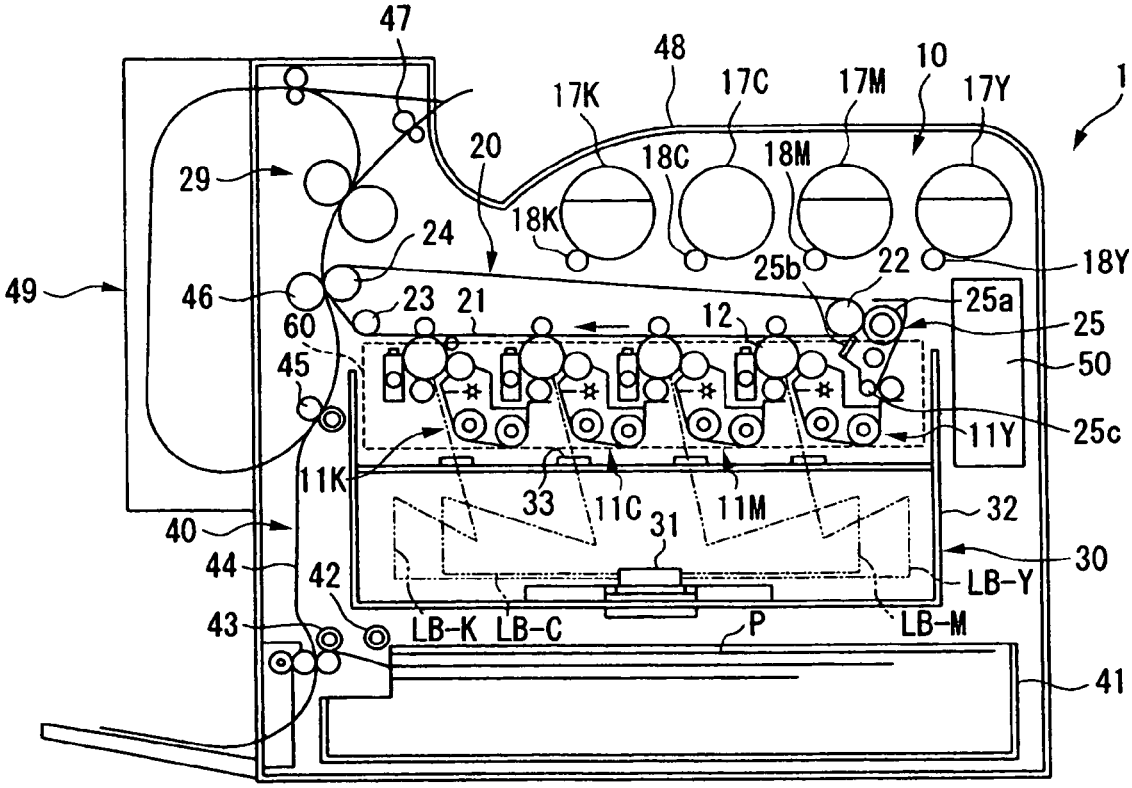
FIG. 1 shows the outline of a printer to which the present embodiment is applied.

FIG. 1 shows the overall configuration of a printer as an image forming apparatus to which the present embodiment is applied. The printer 1 includes: an image forming system 10, which performs image formation corresponding to gradation data of each color; a sheet conveying system 40, which conveys a recording sheet of paper P (recording material); and an IPS (image processing system) 50, which is connected to, for example, a personal computer, an image reader, or the like to perform predetermined image processing on received image data.

The image forming system 10 includes: four-color, i.e., yellow (Y), magenta (M), cyan (C), and black (Y) image forming units 11Y, 11M, 11C, and 11K; a transfer unit 20, which multi-transfers individual color toner images formed on photoconductor drums 12 of the image forming units 11Y, 11M, 11C, and 11K, onto an intermediate transfer belt 21 conveyed in a circulating manner; and a raster output scanner (ROS) 30 serving as optical system which irradiates the image forming units 11Y, 11M, 11C, and 11K with light. Also, the printer 1 includes a fixing device 29, which fixes a toner image secondarily transferred onto the recording sheet of paper P by the transfer unit 20, with use of heat and pressure. Moreover, developer bottles 17C, 17M, 17C, and 17K provided above the transfer unit 20 contain developers corresponding to individual colors of the image forming units 11Y, 11M, 11C, and 11K. The developer bottles 17C, 17M, 17C, and 17K are detachably provided in the printer 1. For example, the developer bottles are also adapted to be capable of being replaced by the user. Also, supply pipes 18Y, 18M, 18C, and 18K are attached to the developer bottles 17C, 17M, 17C, and 17K, respectively, so as to carry new developers to developing devices 14 of individual colors, Incidentally, in the present embodiment, each of the yellow, magenta, cyan image forming units 11Y, 11M, and 11C servers as a color-image forming unit.

Also, in the present embodiment, of the image forming units 11Y, 11M, 11C, and 11K, the black-image forming unit 11K is disposed on the most downstream in the conveying direction of the intermediate transfer belt 21.

The transfer unit 20 includes: a drive roller 22, which drives the intermediate transfer belt 21 serving as an intermediate transfer body or transfer material; a tension roller 23, which applies a predetermined degree of tension to the intermediate transfer belt 21; a pickup roller 24 for secondarily transfer superposed individual color toner images onto a recording sheet of paper P; and a cleaning blade 25, which removes a residual toner existing on the intermediate transfer belt 21. The intermediate transfer belt 21 stretches among the drive roller 22, the tension roller 23, and the pickup roller 24, and is adapted to be driven in a circulating manner at a given speed in a direction indicated by the arrow by the drive roller 22, which is rotatingly driven by a dedicated motor (not shown) having excellent constant velocity performance. A belt adjusted in resistance with a belt material (rubber or resin), which does not cause charge-up, is used as the intermediate transfer belt 21. A belt cleaner 25 serving as a cleaning unit or an intermediate-transfer cleaning section, includes a cleaning brush 25*a* and a cleaning blade 25*b*, which are disposed in contact with the intermediate transfer belt 21. The belt cleaner 25 removes residual toner, etc. from a surface of the intermediate transfer belt 21 after a secondary transfer process of a toner image is completed and then is prepared for a next image formation process. A discharge auger 25*c* is provided at the inner bottom of the belt cleaner 25 to carry residual toner, etc., which has been removed by the cleaning brush 25*a* and the cleaning brush 25*b*, to the outside of the belt cleaner 25 along a direction orthogonal to the conveying direction of the intermediate transfer belt 21.

A ROS 30 includes a laser diode and a modulator, both of which are not shown, as well as a polygonal mirror 31, which deflects laser beams (LB-Y, LB-M, LB-C, and LB-K) emitted from the laser diode. In an example illustrated in FIG. 2, since the ROS 30 is provided below the image forming units 11Y, 11M, 11C, and 11K, it has a possibility of being soiled due to dropping of toner, etc. Thus, the ROS 30 is configured such that a frame 32 is formed in the shape of a rectangular parallelepiped to hermetically seal individual components, and a window 33 made of glass is mounted above the frame 32 for allowing the laser beams (LB-Y, LB-M, LB-C, and LB-K) to pass therethrough, thereby improving a shielding effect along with scanning and exposing effects.

The sheet conveying system 40 includes: a sheet feed device 41, which stacks and feeds recording sheets of paper P on which an image is to be recorded; a nudger roller 42, which takes up and feeds the recording sheets of paper P from the sheet feed device 41; a feeding roller 43, which separates the recording sheets of paper P fed from the nudger roller 42 one by one to convey the separated sheet of paper; and a conveying path 44 along which the recording sheet of paper P separated one by one by the feeding roller 43 are conveyed toward a secondary transfer position. The sheet conveying system 40 further includes a registration roller 45, which conveys the recording sheet of paper P conveyed along the conveying path 44 toward the secondary transfer position with controlling timing; and a secondary transfer roller 46, which is provided at the secondary transfer position and is in pressure contact with a backup roller 24 while sandwiching a recording sheet P therebetween, to secondarily transfer an image onto the recording sheet of paper P. Further, the sheet conveying system 40 further includes: a discharge roller 47, which discharges a recording sheet of paper P having an image fixed by the fixing device 29 to the outside of the printer 1; and a discharge tray 48 in which the recording sheets of paper P discharged by the discharge roller 47 are stacked. Furthermore, the sheet conveying system 40 includes a conveying unit 49 for double-sided recording, which inverts a recording sheet of paper P having an image fixed thereon to allow double-sided recording.

Also, a collection bottle 60, which is indicated by a broken line in the drawing, is attached to a portion of the printer 1 in front of the image forming units 11Y, 11M, 11C, and 11K in the drawing. Waste developer to be described below is collected into and contained in the collection bottle 60. Incidentally, in the present embodiment, the secondary transfer roller 46 and the backup roller 24 form a secondary transfer section.

Figure 2:
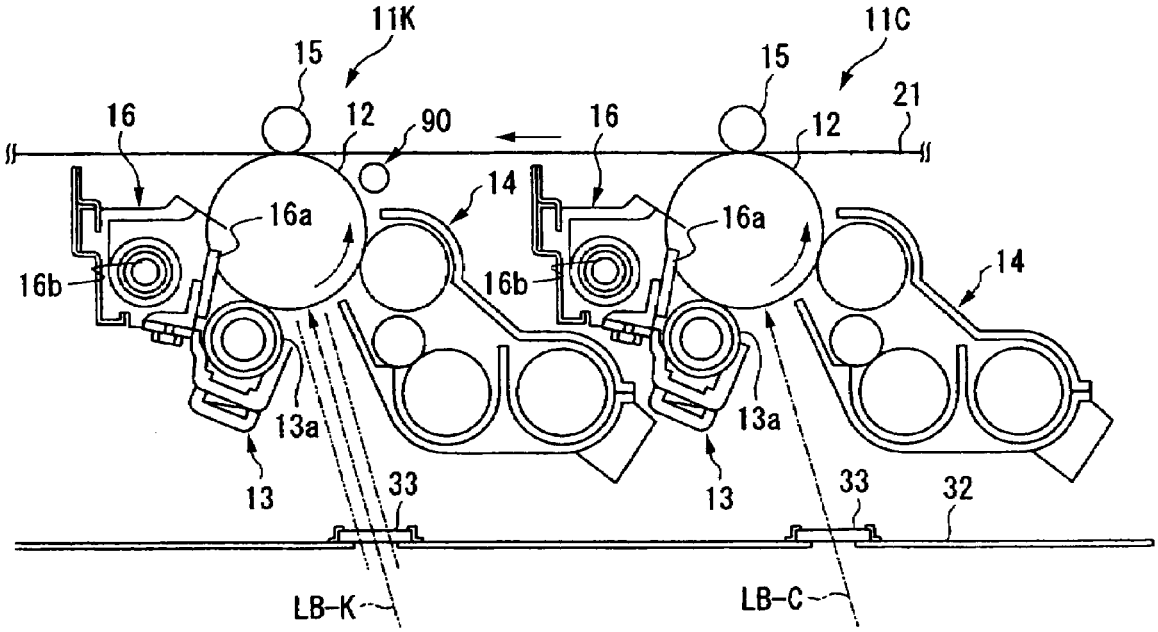
FIG. 2 illustrates the configuration of an image forming unit.

Next, the image forming units 11Y, 11M, 11C, and 11K in the image forming system 10 will be described in detail. FIG. 2 is a drawing for explaining the configuration of the image forming units 11Y, 11M, 11C, and 11K. In this drawing, only the cyan (C) image forming unit 11C and the black-image forming unit 11K are shown. Incidentally, in the present embodiment, only the black-image forming unit 11K has a configuration partially different from the other image forming unit 11Y, 11M, and 11C, specifically, a configuration having a foreign-matter collecting mechanism 90 to be described below, and the yellow (Y) image forming unit 11Y and the magenta (M) image forming unit 11M has the same configuration as the cyan (C) image forming unit 11C.

The image forming units 11Y, 11M, 11C, and 11K includes: a photoconductor drum 12 serving as a latent-image carrier or an image carrier, which is rotatably disposed; and a charging device 13, which charges the photoconductor drum 12 with use of a charging roller 13*a*. Further, each of the image forming units 11Y, 11M, 11C, and 11K includes a developing device 14 serving as a developing unit or a developing section, which develops a latent image formed on the photoconductor drum 12 by the laser beams (LB-Y, LB-M, LB-C, and LB-K) from the ROS 30 with toner. Furthermore, each of the image forming units 11Y, 11M, 11C, and 11K includes a drum cleaner 16 serving as a cleaning unit, a cleaning section, or an image-carrier cleaning section, which is provided to face the photoconductor drum 12 with sandwiching the intermediate transfer belt 21 therebetween. The drum cleaner 16 removes residual toner remaining on the photoconductor drum 12 after primary transfer. Incidentally, the photoconductor drum 12 is grounded.

In the present embodiment, the photoconductor drum 12 is obtained by forming an organic photosensitive layer on a surface of a metallic thin-walled cylindrical drum. The organic photosensitive layer is formed of a material having negatively charged polarity. Further, the charging device 13 applies a negative bias to the charging roller 13*a* to charge the organic photosensitive layer of the photoconductor drum 12 in negative polarity. Also, the developing device 14 performs development with a reverse developing method. Accordingly, the toner used in the developing device 14 is of a negative polarity charging type. Incidentally, although a two-component developing method using developer containing toner and carrier in the developing device 14 is employed in the present embodiment, the details thereof will be described below. Further, a primary transfer bias of polarity (positive polarity) reverse to the charged polarity of toner is applied to a primary transfer roller 15 so that a toner image on the photoconductor drum 12 is transferred to the intermediate transfer belt 21. Furthermore, the drum cleaner 16 has the cleaning blade 16*a* serving as a cleaning member, which is disposed to come into pressure contact with the photoconductor drum 12 in a counter direction to a rotation direction thereof to scrape off a residual toner attached to the photoconductor drum 12. A discharge auger 16*b* is provided inside the drum cleaner 16. The discharge auger 16*b* carries the residual toner scraped off by the cleaning blade 16*a* to the outside of the drum cleaner 16 along the axial direction of the photoconductor drum 12.

The black-image forming unit is provided with a foreign-matter collecting mechanism 90 serving as a foreign-matter collecting unit, which is disposed on downstream of the developing device 14 in the rotation direction of the photoconductor drums 12 and on upstream of a facing portion between the photoconductor drum 12 and the intermediate transfer belt 21 (primary transfer roller 15). The foreign-matter collecting mechanism 90 removes foreign matters such as paper debris attached to the black image photoconductor drum 12. Incidentally, in the present embodiment, as described below, the black-image developing device 14 is supplied with the toner recovered from the belt cleaner 25. Therefore, there is a possibility that foreign matters, which have been reversely moved from a recording sheet of paper P during the secondary transfer and attached to the intermediate transfer belt 21 again, may also be collected in the belt cleaner 25. Accordingly, there is a fear that foreign matters such as paper debris may be mixed into the black-image developing device 14 and may be moved and attached to the photoconductor drum 12.

Figure 3:
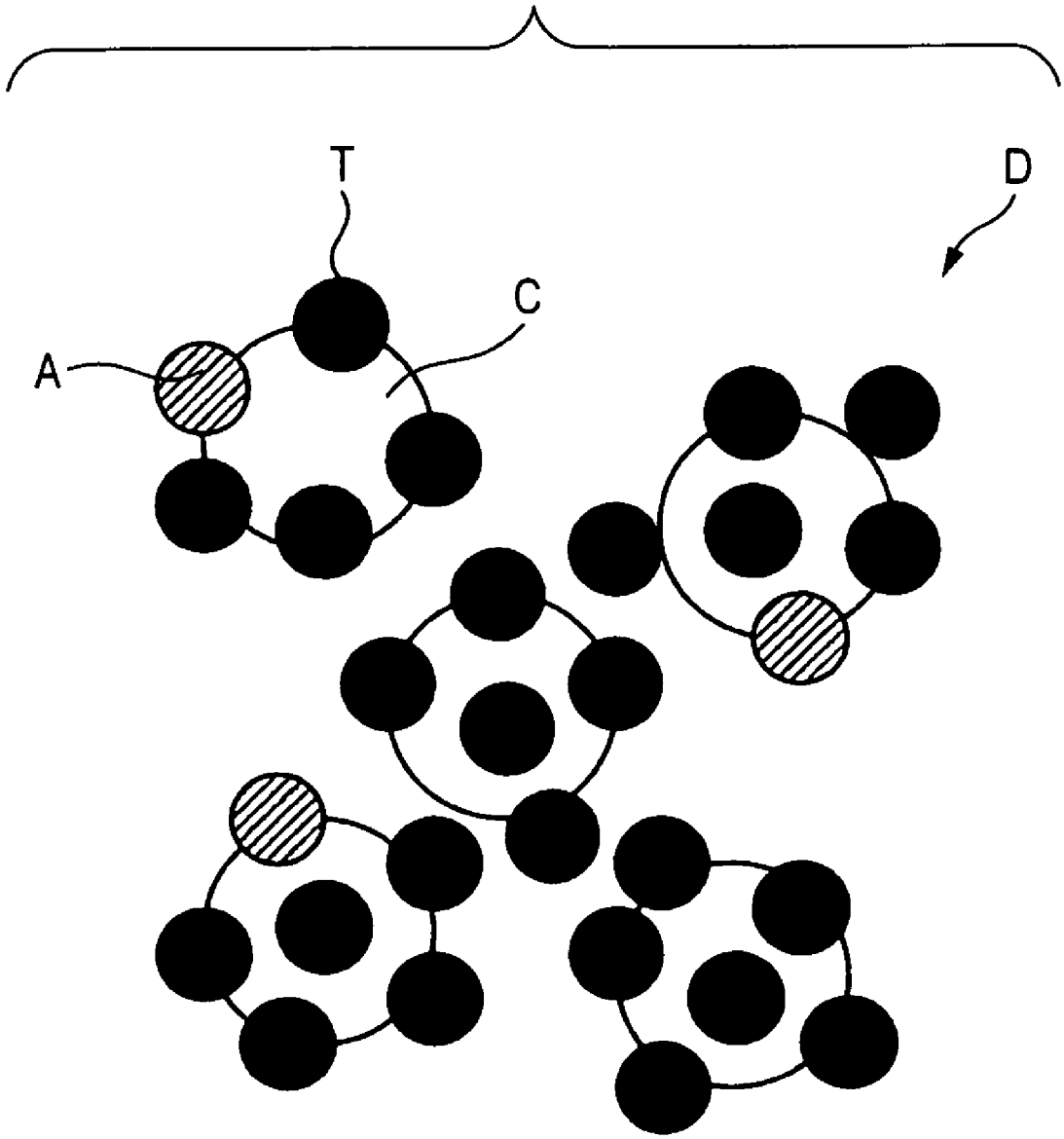
FIG. 3 illustrates the composition of developer.

Next, referring to FIG. 3, developer D used in the present embodiment will be described in detail. The developer D contains carrier C having polarity and toner T colored in yellow, magenta, cyan, or black. Further, the developer D contains a cleaning agent A, which reduces a frictional force acting between the photoconductor drum 12 and the cleaning blade 16*a* and functions as lubricant to suppress wear of the photosensitive layer provided on the photoconductor drum 12. Furthermore, an appropriate amount of external additive (not shown) is added to the developer D.

Ferrite beads having a mean grain size of 35 μm are used as the carrier C in the developer D.

Also, as the cleaning agent A, zinc stearate is used, which is substantially colorless and transparent and of which mean grain size is set to be approximately equal to that of the toner T to be described below. The zinc stearate has a charged polarity (positive polarity in the present embodiment) that is polarity reverse to toner. Incidentally, the content of the cleaning agent A (zinc stearate) in the developer D is about 0.5%. Fatty acid metal salts such as calcium stearate, and oxide cerium other than the above-mentioned zinc stearate may be used as the cleaning agent A.

Furthermore, inorganic fine particles, such as silica and titania, having a mean grain size of 5 nm to 200 nm are used as the external additive.

The toner T has polarity charged in negative polarity ad described above, and is fine particles obtained by internally adding colorant and wax to binder resin such as polyester resin or styrene acrylic resin by a suspension polymerization method, an emulsion aggregation combining method, or a dissolution suspension method. As the grain size of the toner, the volume mean grain size that is measured by a coulter counter (made by Beckman Coulter, Inc.) is 5 μm, and the grain size distribution (GSD) is 1.23. The toner shape (degree of roundness) is represented by a shape factor. An image analyzer, Luzex3 (Nireco Corporation), is used to perform an image analysis for an enlarged photograph of toner obtained using an optical microscope (Microphoto FXA made by Nikon Corporation), to obtain the shape factor. The shape factor is calculated with the following expression.

$$\text{shape factor}(ML^2/A) = \frac{(\text{absolute maximum length of toner})^2}{\text{projection area of toner}} \times \frac{\pi}{4} \times 100$$

This expression is represented by the ratio of a projected area of toner to an area of a circle externally tangent to the projected toner. In a case where the projected toner is a true sphere, the shape factor is 100. As a shape of the projected toner is away from the true sphere, the shape factor increases. If the shape factor is small, the amount of residual toner remaining without being transferred during the transfer process decreases. Therefore, the shape factor of the toner T is preferably in a range of about 100 to 140. In the present embodiment, the shape factor is in a range of 129 to 134. Incidentally, the volume mean grain size of the toner T is preferably in a range of 3 μm to 10 μm from the viewpoint of formation of a high-quality image.

Figure 4:
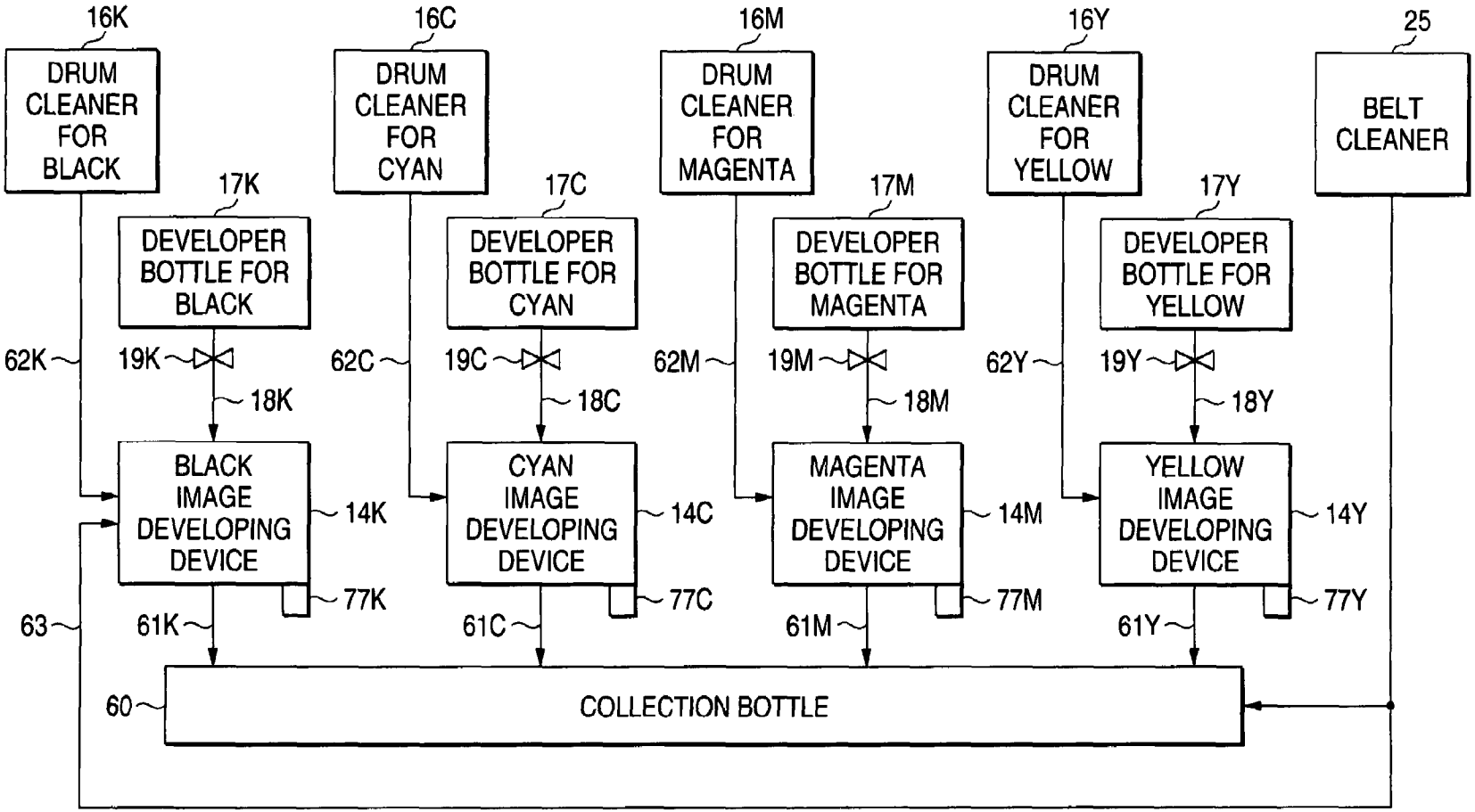
FIG. 4 illustrates a flow from supply of the developer to disposal thereof in the printer.

FIG. 4 illustrates a flow from supply of the developer D to discarding thereof in the printer 1.

The printer 1 according to the present embodiment employ a trickle method in which the developing devices 14Y, 14M, 14C, and 14K of the image forming units 11Y, 11M, 11C, and 11K are supplied with new developers D at a predetermined timing and as a result, developer D, which is left over inside the developing devices, are discarded to the outside as waste developer. By employing such a trickle method, replenishment of the toner T and removal of the carrier C deteriorated due to the use of the toner for an extended period of time are simultaneously performed in each of the developing devices 14Y, 14M, 14C, and 14K.

Specifically, new developer D of each color is supplied to each of the developing devices 14Y, 14M, 14C, and 14K through each of the supply pipes 18Y, 18M, 18C, and 18K from each of the developer bottles 17C, 17M, 17C, and 17K. Waste developer is discarded to the collection bottle 60 through each of waste pipes 61Y, 61M, 61C, and 61K. A toner-concentration detecting sensor 77 is attached to each of the developing devices 14Y, 14M, 14C, and 14K to detect the concentration of toner in the developer D contained inside each developing device. Each of shutters 19Y, 19M, 19C, and 19K is attached to each of the supply pipes 18Y, 18M, 18C, and 18K. Also, the respective shutters 19Y, 19M, 18C, and 19K are normally to a closed state. When a decrease in concentration of toner is detected by the toner-concentration detecting sensors 77Y, 77M, 77C, and 77K respectively provided in the developing devices 14Y, 14M, 14C, and 14K, each of the shutters 19Y, 19M, 19C, and 19K is set to its open state by a control section (not shown) and new developer is supplied to a corresponding developing device 14. Incidentally, the supply of developer D to each of the developing devices 14Y, 14M, 14C, and 14K is controlled independently.

On the other hand, in the printer 1, respective color-component recovered toners are collected by drum cleaners 16Y, 16M, 16C, and 16K provided in the image forming units 11Y, 11M, 11C, and 11K, and discharged by the discharge auger 16*b* (see FIG. 2). The respective color-component recovered toners are then returned to the developing devices 14Y, 14M, 14C, and 14K of the same colors through carrying pipes 62Y, 62M, 62C, and 62K, respectively. Also, in the printer 1, all or a part of the recovered toner, which has been recovered by the belt cleaner 25 provided in the intermediate transfer belt 21 shown in FIG. 1 and discharged by the discharge auger 25*c*, is returned to the black-image developing device 14 through a carrying pipe 63. Incidentally, the remaining recovered toner, which has been collected by the belt cleaner 25 and has not returned to the black-image developing device 14, is discarded to the collection bottle 60. Also, a carrying auger (not shown) is attached to the inside of the carrying pipes 62Y, 62M, 62C, and 62K and the carrying pipe 63. By rotating the carrying auger, the recovered toner is carried to each of the developing devices 14Y, 14M, 14C, and 14K. Incidentally, in the printer 1, a recovered toner containing the yellow, magenta, cyan, and black color components is discharged from the belt cleaner 25. In this case, the recovered toner is returned to the black-image developing device 14 and mixed with a large amount of black toner. Therefore, there arises no problem. Incidentally, in the present embodiment, the respective drum cleaners 16Y, 16M, 16C, and 16K and the respective carrying pipes 62Y, 62M, 62C, and 62K serve as a recovered-toner supply unit or recovered-toner supply sections, and the carrying pipe 63 serves as a recovered-toner supply unit.

Here, in the present embodiment, as shown in FIG. 1, the black-image forming unit 11K is disposed on downstream of the yellow, magenta and cyan image forming units 11Y, 11M and 11C in the moving direction of the intermediate transfer belt 21. Therefore, the black toner transferred onto the intermediate transfer belt 21 reaches the secondary transfer section without passing through the primary transfer sections for the other colors (yellow, magenta, and cyan). That is, it is possible to prevent occurrence of a problem that the black toner is transferred onto the photoconductor drums for the other colors by retransfer and then collected by the drum cleaners 16 for the other colors, and thereby mixed in the developing device 14 for the other colors. As a result, it is possible to prevent occurrence of a problem that toner of each color of yellow, magenta, and cyan becomes dull gradually due to mixing of the black toner.

Figure 5:
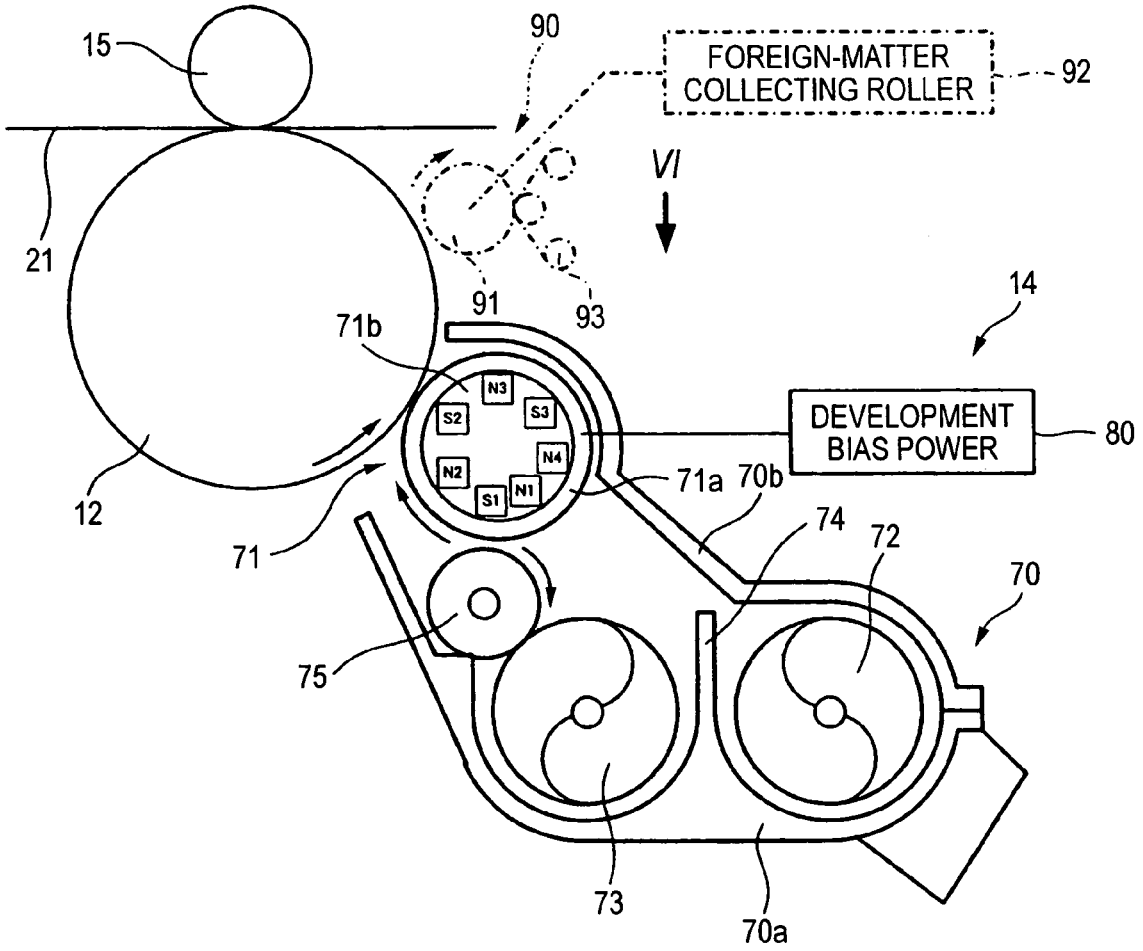
FIG. 5 is a side sectional view of a developing device.
Figure 6:
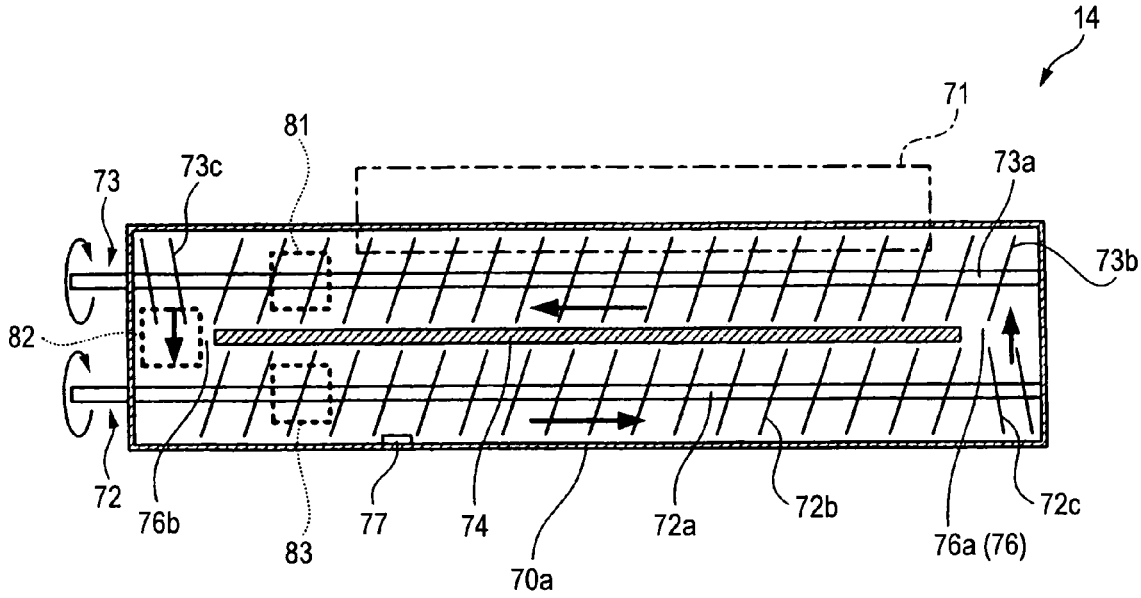
FIG. 6 is a top plan view of the developing device used in Embodiment 1.

Next, the developing device 14 will be described in detail. FIG. 5 is a side sectional view of the developing device 14. FIG. 6 is a top plan view of the developing device 14 as seen from a VI direction in FIG. 5. Here, FIG. 6 shows a state in which an upper housing 70*b*, a developing roller 71, a layer-thickness regulating roller 75, which will be described below, are removed from the developing device 14.

The developing device 14 includes: a developing housing 70, which has an opening (opening for development) facing the photoconductor drum 12 and accommodates developer D (not shown) containing toner and carrier; and a developing roller 71 serving as a developing unit or a developer carrier, which is disposed at a position where it faces the opening of the developing housing 70. Here, the developing housing 70 includes: a lower housing 70*a* provided in a lower portion thereof; and an upper housing 70*b*, which is provided above the lower housing 70*a* and detachably mounted on the lower housing 70*a*. A pair of screw augers 72 and 73 serving as agitating and carrying members are provided at a rear bottom of the developing roller 71 (as seen from the photoconductor drum 12) within the developing housing 70. The pair of screw augers 72 and 73 are arranged substantially parallel to the axial direction of the photoconductor drum 12. Incidentally, in the following description, a screw auger 72 farther from the developing roller 71 is referred to as a first screw auger, and a screw auger 73 closer to the developing roller 71 is referred to as a second screw auger. A partition wall 74 is provided between the first screw auger 72 and the second screw auger 73 to partition the space within the developing housing into two spaces for the first screw auger 72 and for the second screw auger 73. The partition wall 74 is integrally formed with the lower housing 70*a*. Further, the layer-thickness regulating roller 75 is rotatably provided below the developing roller 71 at a predetermined distance from the developing roller 71 to regulate the thickness of the developer layer on the developing roller 71.

Here, the developing roller 71 has a rotatable developing sleeve 71*a*, and a magnet roller 71*b*, which is fixedly disposed inside the developing sleeve 71*a* and has a plurality of magnets arrayed therein. The developing sleeve 71*a* is adapted to be rotatingly driven in the direction indicated by the arrow by a motor (not shown), and is adapted to rotate in the same direction as the photoconductor drum 12 at a development position where it faces the photoconductor drum 12. Further, the developing sleeve 71*a* is made of metal, for example, SUS or the like, and is connected to a development bias power 80, which applies a development bias composed of a direct current bias having an alternating current superposed thereon. Incidentally, the above-described layer-thickness regulating roller 75 is adapted to rotate in a direction reverse to the developing sleeve 71*a* at a layer-thickness regulated position where it faces the developing sleeve 71*a*.

The magnet roller 71*b* has seven magnetic poles N1 to N4 and S1 to S3 formed along its outer peripheral surface. Here, the magnetic pole N1 (pickup pole) has a function of attracting the developer D (not shown) agitated and carried by the second screw auger 73 onto the developing sleeve 71*a*. The magnetic pole S1 (trimming pole) has a function of forming a predetermined developer layer by using a gap defined between itself and the layer-thickness regulating roller 75 facing it. Further, the magnetic poles N2, N3, and S3 (carrying poles) carry the developer D attracted onto the developing sleeve 71*a* with the rotation of the developing sleeve 71*a*. Furthermore, the magnetic pole S2 (developing pole) has a function of carrying the developer D attracted onto the developing sleeve 71*a* and forming nap of the developer in a developing area where it faces the photoconductor drum 12. Also, the magnetic pole N4 (pickup pole) has a function of forming a repulsion electric field together with the adjacent magnetic pole N1 (pickup pole) and peeling off the developer D attracted to the developing sleeve 71*a* from the developing sleeve 71*a*.

As shown in FIG. 6, the first screw auger 72 has a rotating shaft 72*a* and blades 72*b* spirally attached to the outer periphery of the rotating shaft 72*a*. The first screw auger 72 is adapted to carry the developer D (not shown) to the right in the drawing. Meanwhile, the second screw auger 73 also has a rotating shaft 73*a* and blades 73*b* attached to the outer periphery of the rotating shaft 73*a*. The second screw auger 73 is adapted to carry the developer D (not shown) to the left in the drawing). Incidentally, the rotating shaft 72*a* of the first screw auger 72 and the rotating shaft 73*a* of the second screw auger 73 are rotatably supported by the lower housing 70*a*. Theirs one ends protrude outward from the lower housing 70*a*. Also, the first screw auger 72 and the second screw auger 73 are rotatingly driven by a driving mechanism (not shown).

Furthermore, axial opposite ends of the lower housing 70*a* are provided with communicating ports 76 (specifically, 76*a* and 76*b*) through which the developer D (not shown) is transferred between the first screw auger 72 and the second screw auger 73. Here, blades 72*c* are formed on downstream of the first screw auger 72 in the developer carrying direction, that is, at the communicating port 76*a*. These blades 72*c* are arranged at shorter pitches than the blades 72*b* in a direction reverse to the blades 72*b*, and are adapted to feed the developer D carried by the first screw auger 72 toward the communicating port 76*a*. Meanwhile, the blades 73*c* are formed on downstream of the second screw auger 73 in the developer carrying direction, that is, at the communicating port 76*b*. These blades 72*c* are arranged at shorter pitches than the blades 73*b* in a direction reverse to the blades 72*b*, and are adapted to feed the developer D carried by the second screw auger 73 toward the communicating port 76*b*. Incidentally, the communicating ports 76*a* and 76*b* are located outside the axial opposite ends of the developing roller 71.

Further, a recovered-toner carry-in port (recovered-toner carry-in section) 81 is formed on downstream of a portion facing the developing roller 71 in the developer carrying direction, for carrying the recovered toner fed from the drum cleaner 16 into the developing device 14. In the present embodiment, the recovered-toner carry-in port 81 is provided above the second screw auger 73. Incidentally, in the black-image developing device 14K, the recovered toner carried from the belt cleaner 25 and the recovered toner carried from the drum cleaner 16K for black are carried in from the recovered-toner carry-in port 81.

Furthermore, a developer discharge port (excess developer discharge section) 82 is formed on downstream of the recovered-toner carry-in port 81 in the developer carrying direction, to discharge the developer D, which is left over in the developing device 14, to the outside of the developing device 14. In the present embodiment, the developer discharge port 82 is provided above the communicating port 76*b*.

Also, a developer carry-in port (new-developer carry-in section) 83 is formed on downstream of the developer discharge port 82 in the developer carrying direction and on upstream of a portion facing the developing roller 71 in the developer carrying direction, to carry the developer D supplied from the developer bottle 17 into the developing device 14.

Incidentally, the recovered-toner carry-in port 81, the developer discharge port 82, and the developer carry-in port 83 are provided in the upper housing 70*b* (see FIG. 5).

The toner-concentration detecting sensor 77 is attached to the wall face of the lower housing 70*a* on downstream of the developer carry-in port 83 in the developer carrying direction, to detect the concentration of toner in the developer D in the developing device 14. As the toner-concentration detecting sensor 77, for example, a magnetic permeability sensor, etc. can be used.

Furthermore, in FIG. 5, the foreign-matter collecting mechanism 90 provided only in the black-image forming unit 11K is indicated by a one-dot chain line. The foreign-matter collecting mechanism 90 includes a foreign-matter collection bias power 92, as a bias-applying section, which applies a predetermined collection bias to a foreign-matter collecting roller 91, and a web cleaner 93 serving as a cleaning member, which removes foreign matters moved and attached to the foreign-matter collecting roller 91.

The foreign-matter collecting roller 91 is made of, for example, a conductive material such as stainless. Also, guide rollers (not shown), which have a slightly larger diameter than the foreign-matter collecting roller 91, are respectively attached to axial opposite ends of the foreign-matter collecting roller 91. These guide rollers abut against the axial opposite ends (areas where the organic photosensitive layer is not formed) of the photoconductor drum 12. With this arrangement, the foreign-matter collecting roller 91 rotates with rotation of the photoconductor drum 12. Also, the guide rollers allow the foreign-matter collecting roller 91 to be put in non-contact with the photoconductor drum 12, and a distance between the photoconductor drum 12 and the foreign-matter collecting roller 91 to be kept constant (in this embodiment, 0.5 mm).

Further, the foreign-matter collection bias power 92 applies a collection bias having the same polarity as the toner T (negative polarity in the present embodiment) to the foreign-matter collecting roller 91. As a result, an electric field directed toward the foreign-matter collecting roller 91 from the photoconductor drum 12 is formed.

Furthermore, the web cleaner 93 has a windable web. The web cleaner is configured such that a web is supplied from one web supply roller and the web is collected by the other web-collecting roller. In the present embodiment, at a portion of the web cleaner 93 facing the foreign-matter collecting roller 91, the moving direction of the web is reverse to the moving direction of the foreign-matter collecting roller 91. Also, a web press roller made of sponge is disposed at the back side of the web which comes in contact with the foreign-matter collecting roller 91. This web press roller presses the web against the foreign-matter collecting roller 91. Incidentally, although the present embodiment has been described about the case in which cleaning of the foreign-matter collecting roller 91 is performed using the web cleaner 93, the invention is not limited thereto. For example, a fixing pad may be pressed against the foreign-matter collecting roller 91, or a scraper, a blade, or the like may come into pressure contact with the foreign-matter collecting roller 91.

Next, the operation of the printer 1 according to the present embodiment will be described. A reflected light image of a color material of a document read by a document reader (not shown) or a color material image data generated by a personal computer (not shown) is input to the IPS50 as, for example, reflectance data consisting of 8 bits of red (R), green (G), and blue (B). In the IPS50, various kinds of image processing such as shading correction, positional deviation correction, brightness/color space correction, gamma correction, frame deleting, and various kinds of editing of color editing, movement editing, etc. are performed on the input reflectance data. The image data, which has been subjected to the image processing, is converted into color material gradation data of four colors of yellow (Y), magenta (M), cyan (C), and black (K) and is output to the ROS 30.

In the ROS 30, the laser beams (LB-Y, LB-M, LB-C, and LB-K) emitted from laser diodes (not shown) according to the input color material gradation data are irradiated onto the polygonal mirror 31 via f-θ lenses (not shown). In the polygonal mirror 31, the input laser beams are converted and deflected according to gradation data of each color, and are irradiated onto the photoconductor drum 12 of each of the image forming units 11Y, 11M, 11C, and 11K via a focusing lens (not shown) and a plurality of mirrors. In the photoconductor drum 12 of each of the image forming units 11Y, 11M, 11C, and 11K, the surface of photoconductor drum charged to, for example, −550 V by the charging device 13 is scanned and exposed. For example, an electrostatic latent image having a potential of, for example, −50 V is formed on the photoconductor drum. The formed electrostatic latent image is developed as a toner image of each color of yellow (Y), magenta (M), cyan (C), and black (K) by each of the image forming units 11Y, 11M, 11C, and 11K.

The toner images formed on the photoconductor drums 12 of the image forming units 11Y, 11M, 11C, and 11K are sequentially transferred onto the intermediate transfer belt 21 by the primary transfer rollers 15. At this time, since the black-image forming unit 11K, which forms a black toner image, is provided on the most downstream in the moving direction of the intermediate transfer belt 21, the black toner image is finally transferred on to the intermediate transfer belt 21.

Meanwhile, in the sheet conveying system 40, as the nudger roller 42 rotates in conformity with image formation timing, and a predetermined size of a recording paper P is fed from the sheet feed device 41. A recording paper P separated one by one by the feeding roller 43 is fed to the registration roller 45 via the conveying path 44, and then stopped once. Thereafter, the registration roller 45 rotates in conformity with moving timing of the intermediate transfer belt 21 having a toner image formed thereon, and the recording paper P is conveyed to the secondary transfer position, which is formed by the backup roller 24 and the secondary transfer roller 46. A toner image on which four color images have been transferred in a superposed manner is secondarily transferred onto the recording paper P be conveyed from the bottom toward the top at the secondary transfer position, sequentially in the sub-scanning direction by use of contact pressure and a predetermined electric field. Then, the recording paper P having the toner image secondarily transferred thereon is subjected to fixing processing with heat and pressure by the fixing device 29, and thereafter, is discharged by the discharge roller 47 to the discharge tray 48 provided at the top of the printer 1. Incidentally, the recording paper P can be inverted by the conveying unit 49 for double-sided recording without being discharged to the discharge tray 48 as it is. After the inverted recording paper P is conveyed to the registration roller 45, another image is formed on the other non-printed side of the recording paper P according to the operation similar to the above one, which makes it possible for images to be formed on both sides of the recording paper P.

Next, the basic operation of the developing device 14 will be described.

The developer D is carried in a circulating manner while being agitated in the developing housing 70, by the first screw auger 72 and the second screw auger 73 rotatingly driven. The agitation causes friction between the carrier C and the toner T constituting the developer D. This friction charges the toner T to the negative polarity. The cleaning agent A is charged to the positive polarity by the friction. When the agitated and carried developer D is carried to the portion facing the developing roller 71, a portion of the developer D is transferred to the developing roller 71 by a magnetic force of a magnet N1 provided in the developing sleeve 71*a* so that the developer D forms a developer layer on the developing sleeve 71*a*. Then, the developer layer is carried with rotation of the rotatingly driven developing sleeve 71*a*. When the developer layer carried by the developing sleeve 71*a* passes through the portion facing the layer-thickness regulating roller 75, the developer layer is regulated to have a predetermined thickness, that is, a predetermined carried amount, and then carried to an opening of the developing housing 70 facing the photoconductor drum 12. Incidentally, the developer D that could not pass through the portion facing the layer-thickness regulating roller 75 is returned to the developing housing 70 with a gravitational force and a torque of the layer-thickness regulating roller 75. A predetermined development bias (for example, a bias in which an alternating current of 1 kV is superposed on a direct current of 350 V peak to peak) is applied to the developing sleeve 71*a* from the development bias power 80. As a result, in a developing area closest to the photoconductor drum 12, the toner T is transferred to a latent image formation area (an area where writing has been performed by the ROS 30) on the photoconductor drum 12 from the developer layer on the developing sleeve 71*a* so that the electrostatic latent image is developed and visualized. Also, the cleaning agent A charged to a polarity reverse to that of the toner T is transferred to a latent image non-formation area (a region where no writing has been performed by the ROS 30) on the photoconductor drum 12. Thereafter, the completely developed developer layer, which has passed through the opening of the developing housing 70, is further carried while being carried on the developing sleeve 71*a*. Then, the developer layer on the developing sleeve 71*a* departs from the developing roller 71 by a repulsion magnetic force formed between the magnets N4 and N1, to drop into the developing housing 70, and is then agitated and carried again by the first screw auger 72 and the second screw auger 73 to wait for the next development.

Figure 7:
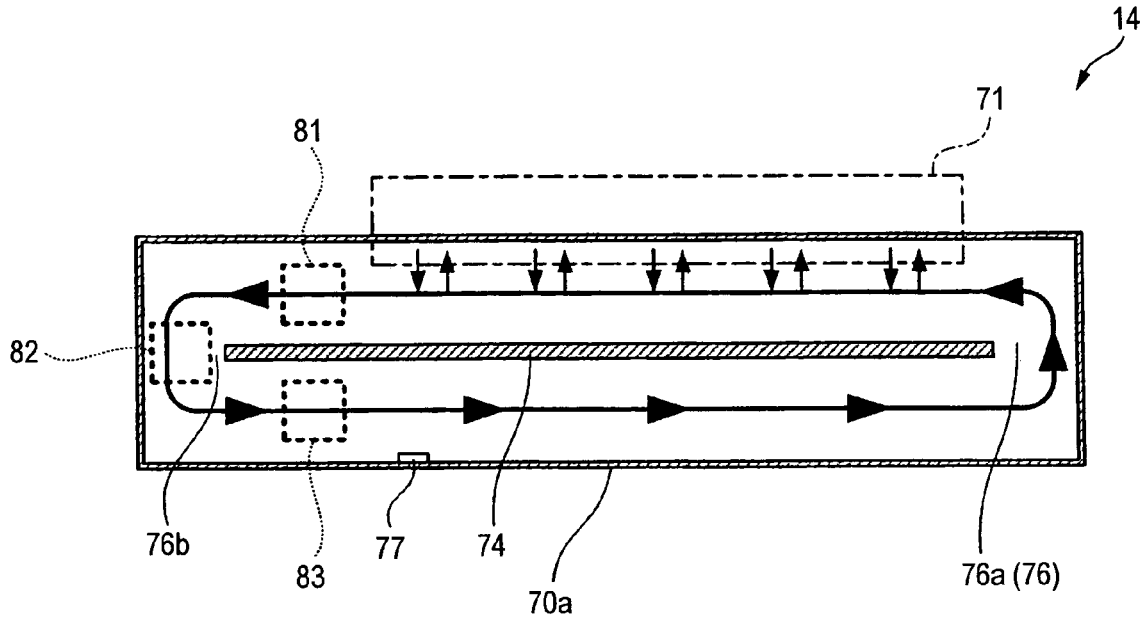
FIG. 7 illustrates a flow in the developer in the developing device used in Embodiment 1.

Next, referring to FIG. 7, the flow of developer D within the developing device 14 will be described. Incidentally, in FIG. 7, illustration of the first screw auger 72 and the second screw auger 73 is omitted and the flow of developer D is shown by the arrow.

If the toner concentration detected (concentration of toner T in developer D) by the toner-concentration detecting sensor 77 is below a predetermined level, new developer D is supplied from a corresponding developer bottle 17 (see FIG. 1). The new developer D is then carried in through developer carry-in port 83. The newly carried-in developer D is agitated and carried together with the developer D, which is already within the developing housing 70.

When the agitated and conveyed developer D reaches the portion facing the developing roller 71, a portion of the developer D is transferred to the developing roller 71. Then, the developer D, which has passed through the portion facing the photoconductor drum 12 (see FIG. 5) and has finished its use for development, departs from the developing roller 71. When the developer D transferred to the developing roller 71 is compared with the developer D departed from then developing roller 71, the concentration (toner concentration) of the toner T in the developer D departed from the developing roller 71 is lowered by the amount of a portion of the toner T transferred to the photoconductor drum 12 by the developing operation. Accordingly, the developer D immediately after it has passed through the portion facing the developing roller 71 has a lower toner concentration than the developer immediately before it has passed through the portion of the developing roller 71.

The developer D, which has passed through the portion facing the developing roller 71, passes under the recovered-toner carry-in port 81. The toner collected by the drum cleaner 16 corresponding to each color is carried through the recovered-toner carry-in port 81. Incidentally, in the black-image developing device 14K, the toner recovered by the belt cleaner 25 is also carried in. The recovered toner is supplied to increase the toner concentration slightly.

Moreover, the developer D, which has passed under the recovered-toner carry-in port 81, then passes under the developer discharge port 82. The developer D, which is left over by supply of the new developer D through the developer carry-in port 83, is discharged through the developer discharge port 82. Here, the developer D, which is left over, contains the carrier C deteriorated due to use of the toner for an extended period of time, the recovered toner carried from the drum cleaner 16 or belt cleaner 25, and the like.

Also, the developer D, which has passed under the developer discharge port 82 again, reaches the position under the developer carry-in port 83. Thereafter, supply of new developer D, development, supply of recovered toner, and discharge of excessive toner are carried out in the above-described order.

Here, the recovered toner supplied through the recovered-toner carry-in port 81 will be described.

In the printer 1 according to the present embodiment, the cleaning blade 16*a* is used in the drum cleaner 16. In this case, a toner dam deposited by the toner T is formed at a pressure-contact portion between the photoconductor drum 12 and the cleaning blade 16*a*. In the present embodiment, since aspherical toner is used as the toner T, high transfer efficiency can be obtained during primary transfer. From the opposite viewpoint thereto, this means the absolute amount of the toner T remaining on the photoconductor drum 12 after the primary transfer is extremely small. If the residual toner T after the transfer is small, the toner T forming the above-described toner dam is not replaced with another one, but the same toner T forms the toner dam for an extended period of time and is kept unchanged. Then, the toner T forming the toner dam may be affected by pressure and frictional heat over the extended period of time. As a result, characteristics of the toner T may deteriorate and aggregation between toner particles may occur.

Also, as described above, the developer D used in the present embodiment contains the carrier C, the toner T, and the cleaning agent A. Thus, the toner T charged to the negative polarity during development is transferred to the latent image formation area (printed area) of the photoconductor drum 12, and the cleaning agent A charged to the positive polarity is transferred to the latent image non-formation area (non-printed area). Further, most of the toner T is transferred to the intermediate transfer belt 21 by a primary transfer bias during the primary transfer, but most of the cleaning agent A is not transferred to the intermediate transfer belt 21. Accordingly, a slight amount of the transfer residual toner T and the cleaning agent A remain on the photoconductor drum 12 after the primary transfer. The cleaning agent A reaches the pressure-contact portion between the photoconductor drum 12 and the cleaning blade 16*a* provided in the drum cleaner 16, and a portion thereof supplements the cleaning operation. Further, the cleaning agent A serves as lubricant between the photoconductor drum 12 and the drum cleaner 16, and has an effect of suppressing wear of the photoconductor drum 12 to extend the life of photoconductor drum 12. However, the cleaning agent A, which does not contribute to such functions, also exists much and even collected together with the transfer residual toner T by the drum cleaner 16. Accordingly, the cleaning agent A having a higher concentration than normal ones is contained the toner collected by the drum cleaner 16.

Incidentally, since almost of the cleaning agent A is not transferred to the intermediate transfer belt 21 as described above, the cleaning agent A hardly exists in a high concentration in the recovered toner supplied to the black-image developing device 14K from the belt cleaner 25. However, since the cleaning brush 25*b* is used even in the belt cleaner 25, the toner T can be aggregated in the recovered toner supplied to the black-image developing device 14K from the belt cleaner 25. Further, although slight, the cleaning agent A is also supplied to the belt cleaner 25.

In the present embodiment, basically, the recovered toner from the drum cleaner 16 or the belt cleaner 25 is recycled to reduce waste from the printer 1. In this case, if the ratio of the recovered toner existing within the developing device 14 increases, the toner T is likely to be aggregated, and the aggregated toner T is hardly transferred to the intermediate transfer belt 21 during transfer, which may cause defect in image quality. Further, if the ratio of the recovered toner existing within the developing device 14 increases, the concentration of the cleaning agent A in the developer D becomes excessively high. Therefore, image characteristics may deteriorate.

Thus, in the present embodiment, as described above, after recovered toner containing the cleaning agent A much is supplied to the developer D, which has passed through the portion facing the developing roller 71, excessive developer D can be discharged before the developer D is supplied with new developer D. Also, after the developing device 14 is supplied with the new developer D, the developer can be used for development. According to this configuration, it is possible to increase the ratio of recovered toner in discharged developer D. The ratio of recovered toner in discharged developer D is increased, so that the ratio of recovered toner in developer D to be transferred to the developing roller 71 and actually used for development can be reduced. That is, it is possible to reduce the probability of existence of aggregated toner T or toner T, which has been stressed by heat or pressure. Further, the concentration of cleaning agent A in developer D to be actually used for development can be prevented from getting high.

As a result, in the present embodiment, even in a case of employing the configuration in which recovered toner is recycled for development, deterioration of developer D in the developing device 14 can be suppressed. Further, since the trickle development method is employed, carrier C deteriorated due to use of toner for an extended period of time can be sequentially disposed and fresh carrier C can be introduced with supply of new developer D. Moreover, in the present embodiment, the absolute amount of waste (waste developer) to be disposed from the printer 1 can be reduced in total. Furthermore, the cleaning agent A is made contained in the developer D, so that wear of the photoconductor drum 12 can be suppressed.

Further, in the present embodiment, in a state in which new developer D is supplied, agitated and carried, the concentration of toner in developer D to be supplied to the developing roller 71 is measured. Accordingly, since the same toner concentration as that during the development can be, measured, and the supply of toner from the developer bottle 17 can be controlled accurately, the concentration of toner in developer D 14 can be set to a proper range.

Meanwhile, in the printer 1 according to the present embodiment, as described above, the recovered toner from the belt cleaner 25 is supplied to the developing device 14K of the black-image forming unit 11K to reuse it for development. Here, the intermediate transfer belt 21 to be cleaned by the belt cleaner 25 comes in contact with a recording paper P conveyed during the secondary transfer. In this state, a secondary transfer bias is applied to the intermediate transfer belt 21. The toner charged to the negative polarity on the intermediate transfer belt 21 is transferred onto the recording paper P by the secondary transfer bias. At this time, paper debris of the recording paper P may be transferred to the intermediate transfer belt 21 by the secondary transfer bias.

Figure 8:
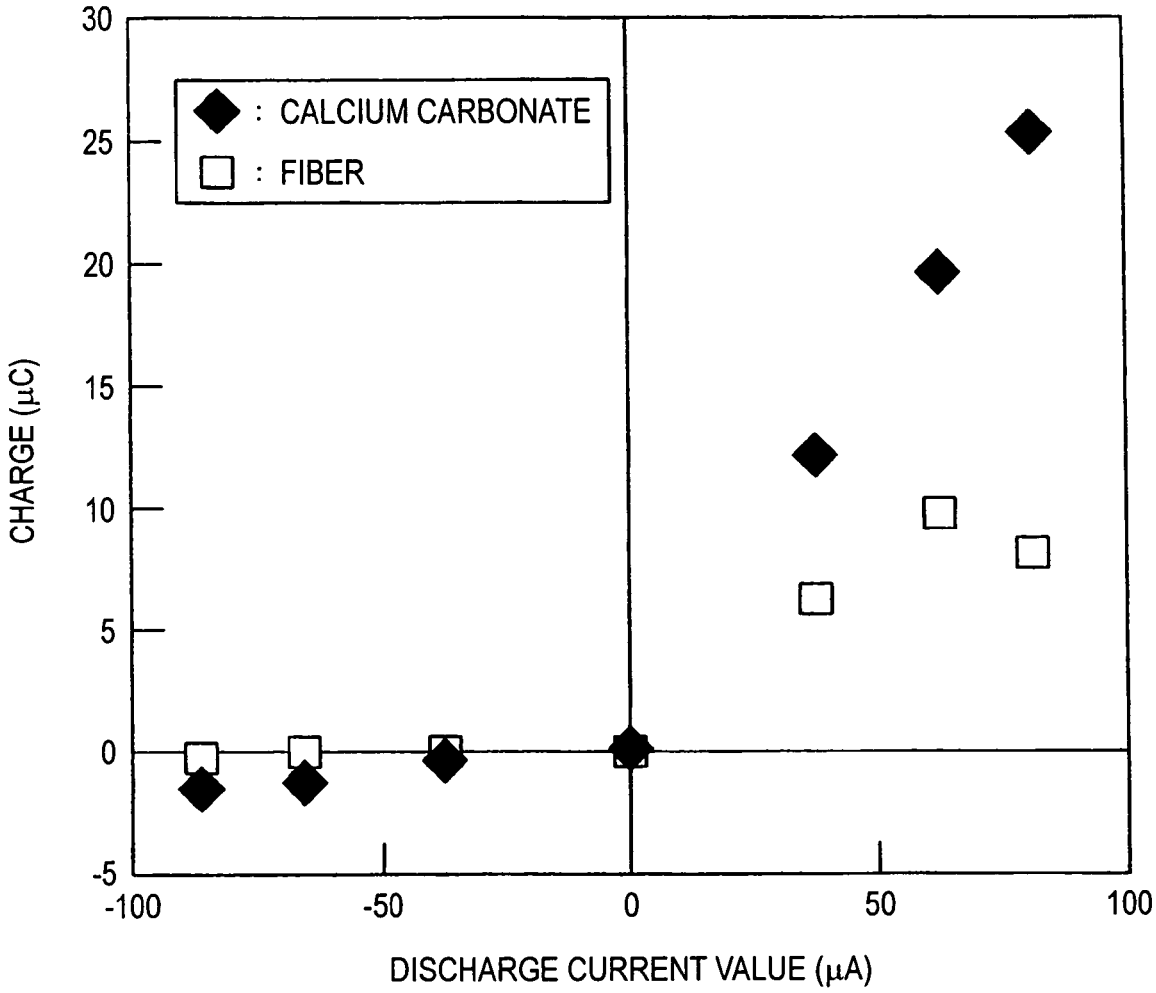
FIG. 8 illustrates the charged polarity of calcium carbonate and fibers constituting paper debris.

FIG. 8 shows results of study on the relationship between a discharge current value for charge and a charged electric charge about calcium carbonate and fiber serving as paper debris of ordinary recording paper P. Incidentally, the calcium carbonate is a material that is often used as filler for raising smoothness, whiteness, basic weight, etc, and is widely used in, particularly, acid-free paper. It can be appreciated from FIG. 8 that the calcium carbonate and fiber have positively charged polarity. Accordingly, in the case in which the negative toner T is used as in the present embodiment, the paper debris is reversely transferred to the intermediate transfer belt 21 during the secondary transfer.

If paper debris is moved and attached to intermediate transfer belt 21 in that manner, the paper debris is collected together with the transfer residual toner by the belt cleaner 25. Also, the toner containing the paper debris collected by the belt cleaner 25 is returned to the inside of the developing device 14. That is, the paper debris may be mixed into the black-image developing device 14K.

Next, the behavior of the developer D and the paper debris in the black-image developing device 14K will be described.

Figure 9:
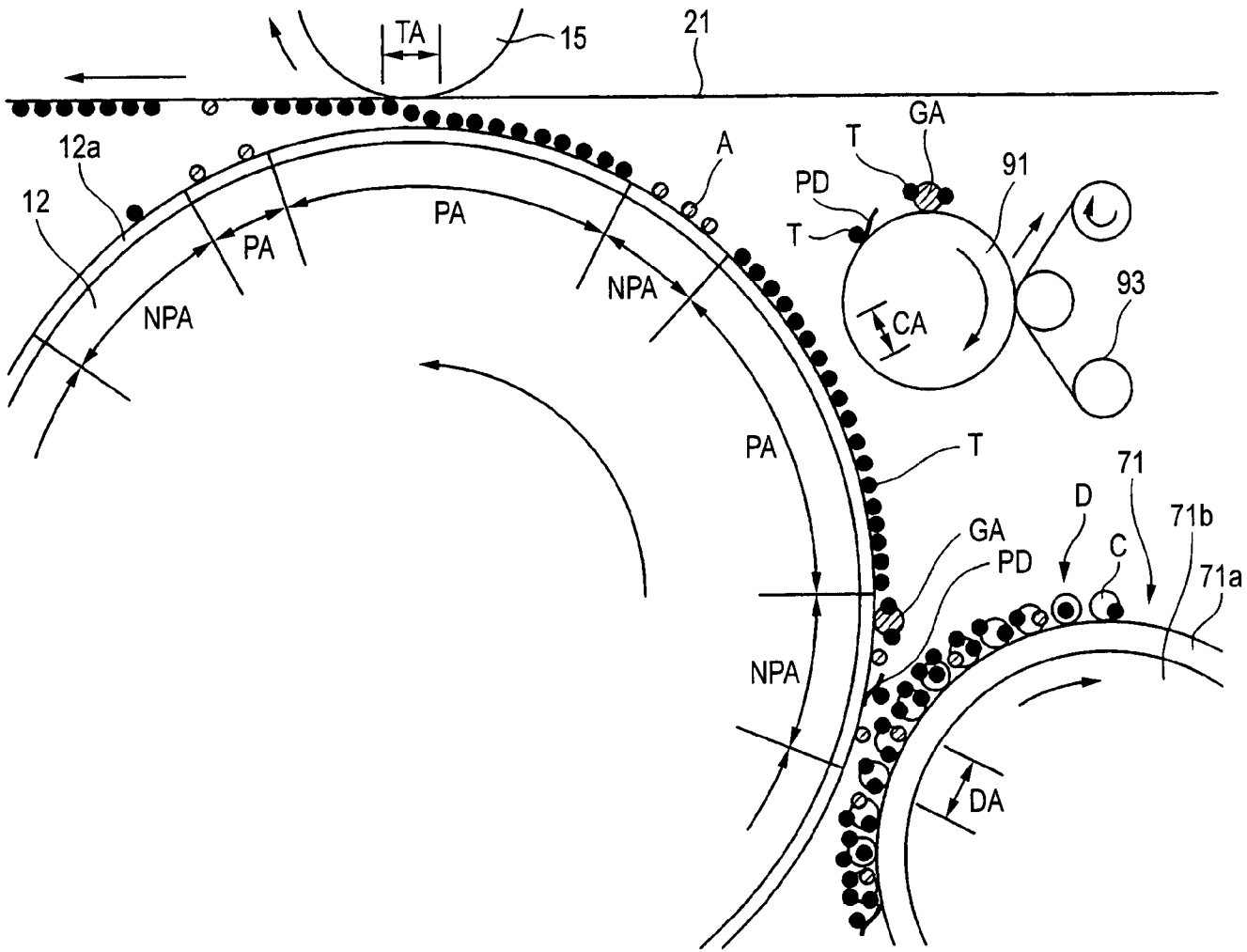
FIG. 9 is a schematic view illustrating the behavior of the developer in a black-image forming unit.

FIG. 9 is a schematic view illustrating the behavior of the developer D (carrier C, toner T, and cleaning agent A) and the paper debris PD in the black-image forming unit 11*k*. Incidentally, an organic conductive layer 12*a* having negatively charged polarity is formed on the photoconductor drum 12.

As described above optical writing is performed by the ROS 30 (see FIG. 1) onto an area where an image is to be formed, on the photoconductor drum 12 charged to a potential of −550 V by the charging device 13 (see FIG. 2). As a result, a latent image formation area (referred to as printed area in the description below) PA (an area having a charged potential of −50 V) on which the optical writing has been performed by the ROS 30 and a latent image non-formation area (referred to as non-printed area in the description below) NPA (an area having a charged potential of −550 V) on which optical writing has not been performed are formed.

Meanwhile, the paper debris PD existing in the black-image developing device 14K (see FIG. 2) is agitated and carried together with the developer D. Since the paper debris PD has positively charged polarity, the toner T having negatively charged polarity while being agitated and conveyed is attached to the paper debris PD. In the portion facing the developing roller 71, the carrier C is transferred to the developing sleeve 71*a* by a magnetic force acting between the magnetic roller 71*b* and the carrier C. At this time, the toner T is attracted to the carrier C by an electrostatic force acting between the magnet roller and the carrier C, and is transferred to the developing roller 71 along with the carrier C. Further, the cleaning agent A is attracted to the carrier C by a van der Waals' force acting between the cleaning agent A and the carrier C, and similarly to the toner T, is transferred to the developing roller 71 along with the carrier C. Accordingly, the developer D containing the carrier C, the toner T and the cleaning agent A is carried on the developing roller 71, thereby forming a magnetic brush. Further, the paper debris PD to which the toner T is attached is caught by, for example, a magnetic brush of the developer D formed on the developing roller 71, so that the paper debris is transferred onto the developing roller 71 and carried thereon. Also, the developer D and the paper debris PD carried on the developing roller 71 is carried to the developing area DA facing the photoconductor drum 12, with rotation of the developing sleeve 71*a*.

In the developing device 14, a development bias composed of a direct current bias having an alternating current of 1 kV superposed thereon. A development bias in which an alternating current of 1 kV is superposed on a direct current of 350 V peak to peak) is applied to the developing sleeve 71*a* from the development bias power 80 (see FIG. 5). Therefore, the printed area PA (−50 V) formed on the photoconductor drum 12 shows a positive potential (300 V) relative to the developing sleeve 71*a* (−350 V). On the other hand, the non-printed area NPA (−550 V) formed on the photoconductor drum 12 shows a negative potential (−200 V) relative to the developing sleeve 71*a* (−350 V). Accordingly, the toner T (charged to negative polarity) on the developing sleeve 71*a* is electrostatically transferred to the printed area PA on the photoconductor drum 12.

Meanwhile, in the present embodiment, the cleaning agent A is charged to positive polarity reverse to the toner T. Therefore, the cleaning agent A is electrostatically transferred to the non-printed area NPA on the photoconductor drum 12. Further, the paper debris PD on the developing roller 71 also is electrostatically charged to positive polarity reverse to the toner T as described above. Therefore, the paper debris PD also is electrostatically moved to the non-printed area NPA on the photoconductor drum 12. At this time, since the paper debris PD is moved to the photoconductor drum 12 together with the toner T attracted to the paper debris PD, the toner T may exist in the non-printed area NPA.

Next, the printed area PA and the non-printed area NPA of the photoconductor drum 12, which have passed through the developing area DA facing the developing roller 71, is conveyed to the foreign-matter collection area CA facing the foreign-matter collecting roller 91 with rotation of the photoconductor drum 12.

A collection bias of, for example, −1300 V is applied to the foreign-matter collecting roller 91 by the foreign-matter collection bias power 92. A potential difference is caused between the foreign-matter collecting roller 91 and the non-printed area NPA (−550 V). Therefore, the paper debris PD (charged to positive polarity) existing on the non-printed area NPA of the photoconductor drum 12 is moved and attached to the foreign-matter collecting roller 91 by an electrostatic force. At this time, most of the toner T attached to the paper debris PD also moves toward the foreign-matter collecting roller 91 while being attached to the foreign-matter collecting roller 91. The paper debris PD moved and attached to the foreign-matter collecting roller 91 is carried to the portion facing the web cleaner 93 with rotation of the foreign-matter collecting roller 91, and removed by the web cleaner 93. Incidentally, although the cleaning agent A charged to negative polarity also exists in the non-printed area NPA, the cleaning agent A is attracted to the photoconductor drum 12 by a van der Waals' force as well as the electrostatic attachment force. Therefore, most of the cleaning agent A is not transferred to the foreign-matter collecting roller 91.

Meanwhile, since the toner T transferred to the printed area PA of the photoconductor drum 12 has negatively charged polarity, when the toner passes through the foreign-matter collection area CA, the toner is conveyed while being carried on the photoconductor drum 12 without being transferred to the foreign-matter collecting roller 91.

Also, the printed area PA and the non-printed area NPA of the photoconductor drum 12, which has passed through the foreign-matter collection area CA facing the foreign-matter collecting roller 91, is carried to a transfer area TA facing the intermediate transfer belt 21 (primary transfer rollers 15) with rotation of the photoconductor drum 12.

In the transfer area TA, a primary transfer bias is applied between the photoconductor drum 12 and the primary transfer rollers 15 (see FIG. 2). Specifically, a primary transfer current having negative polarity is allowed to flow to the grounded photoconductor drum 12 from the primary transfer rollers 15. This electrostatically transfers most of the toner T existing in the printed area PA on the photoconductor drum 12 to the intermediate transfer belt 21. Meanwhile, in the present embodiment, since the cleaning agent A is charged to positive polarity reverse to the toner T, most of the cleaning agent A existing in the non-printed area NPA on the photoconductor drum 12 remains as it is without being electrostatically transferred to the intermediate transfer belt 12. However, a portion of the cleaning agent A is transferred to the intermediate transfer belt 21.

Thereafter, the non-transferred toner (residual toner) T and the cleaning agent A remain on the photoconductor drum 12, which has passed through the transfer area TA. Incidentally, since the above-described spherical toner is used as the toner T in the present embodiment, the transfer efficiency is basically high, and about 95% of the toner T existing on, for example, the photoconductor drum 12 can be transferred to the intermediate transfer belt 21. Therefore, the amount of toner T remaining on the photoconductor drum 12 after the transfer is quite small.

Finally, the non-transferred toner T and the cleaning agent A reach the drum cleaner 16 (see FIG. 2), and the toner T is then removed by the drum cleaner. Further, a portion of the cleaning agent A is coated on the photoconductor drum 12 at the pressure-contact portion between the photoconductor drum 12 and the cleaning blade 16*a* to become a film, and the remaining cleaning agent A is removed by the cleaning blade 16*a*.

In the meantime, since cleaning agent A having charged polarity reverse to the toner T is used in the present embodiment, as described above, the amount of the cleaning agent A to be transferred to the intermediate transfer belt 21 is small. A portion of the cleaning agent A, though slight, is also transferred to the intermediate transfer belt 21. Most of the cleaning agent A transferred to the intermediate transfer belt 21 in this manner is collected by the belt cleaner 25. At this time, the cleaning agent A as well as the toner T remaining without being secondarily transferred may be deposited on the pressure-contact portion between the intermediate transfer belt 21 and the cleaning brush 25*b*, and the deposited cleaning agent A may be aggregated and greatly enlarged due to a stress received from the pressure-contact portion.

The enlarged cleaning agent A as such (aggregate of lubricant: referred to as aggregated cleaning agent GA in the description below) is returned to the black-image developing device 14K, similar to the above-described paper debris PD. Also, the aggregated cleaning agent GA shows the same positively charged polarity as a typical cleaning agent A, and has its own charged amount larger than a typical cleaning agent A. Therefore, in the black-image developing device 14K, the toner T having negatively charged polarity when being agitated and carried is attached to the aggregated cleaning agent GA. As shown in FIG. 9, the aggregated cleaning agent GA is transferred to the non-printed area NPA on the photoconductor drum 12 along with the toner T, similar to the paper debris PD.

In the present embodiment, however, the aggregated cleaning agent GA is also transferred to the foreign-matter collecting roller 91 by an electrostatic force, similar to the paper debris PD. In this case, since the aggregated cleaning agent GA has a large diameter, it has a small mirror image force with respect to the photoconductor drum 12 and consequently has a small attachment force as compared to a typical cleaning agent A. Therefore, the aggregated cleaning agent GA is easily transferred to the foreign-matter collecting roller 91, whereas a typical cleaning agent A is hardly transferred to the foreign-matter collecting roller 91.

In the present embodiment, in the black-image developing device 14K, the paper debris PD or the aggregated cleaning agent GA attached to the photoconductor drum 12 after transfer can be moved and attached to the foreign-matter collecting roller 91. Further, when the paper debris PD or the aggregated cleaning agent GA is moved to the foreign-matter collecting roller 91, most of the toner T attached to the paper debris PD or aggregated cleaning agent GA is collected at once. Therefore, when the non-printed area NPA reaches the transfer area TA, the particle of the toner T existing in the non-printed area NPA is surely reduced.

Further, since the intermediate transfer method is employed in the present embodiment, it is considered that adverse effects due to the aggregated cleaning agent GA will not be a particularly significant problem because the amount of aggregated cleaning agent GA existing in the toner recovered toner by the belt cleaner 25 is relatively small. However, in an image forming apparatus of a type that a toner image formed on a photoconductor drum 12 is directly transferred to a recording paper P, paper debris PD or a large amount of cleaning agent A is collected by the drum cleaner 16. Therefore, the probability of generation of aggregated cleaning agent GA increases. That is, it can be said that removal of the aggregated cleaning agent GA by the foreign-matter collecting roller 91 is particularly effective in the image forming apparatus of the type that the toner image formed on the photoconductor drum 12 is directly transferred to the recording paper P.

Moreover, since a problem associated with the generation of the aggregated cleaning agent GA may be easily caused during the primary transfer, this problem may also occur in the other color-image forming units 11Y, 11M, 11C, and 11K. Accordingly, in a case of using a cleaning agent A which is likely to generate the aggregated cleaning agent GA, it is preferable that the foreign-matter collecting mechanism 90 be attached to not only the black-image forming unit 11K but also the other image forming units 11Y, 11M, 11C, and 11K.

Incidentally, although the present embodiment has been described about an example in which the developer D (two-component developer) containing the carrier C and the toner T, the present invention is not limited thereto. For example, this is can be similarly applied to even a case of using one-component developer which does not contain the carrier C.

Further, the photoconductor drum 12, the foreign-matter collecting roller 91, and the web cleaner 93, which are provided in the black-image forming unit 11K, can be configured as, for example, an integrated drum cartridge. Also, for example, the developing device 14, the drum cleaner 16 and the like other than the foreign-matter collecting roller 91 and the web cleaner 93 can be assembled into a drum cartridge.

Next, an experiment that the inventors conducted to determine the magnitude of a collection bias to be applied to the foreign-matter collecting roller 91 by the foreign-matter collection bias power 92, will be described.

The inventors investigated the removal rate of coarse particle defect (image defect caused by transfer of toner T to the non-printed area NPA and the recording paper P) caused by paper debris PD or aggregated cleaning agent GA by setting the magnitude of a collection bias to be applied to the foreign-matter collection bias power 92 so that the intensity of an electric field (applied magnetic field) to be formed between the photoconductor drum 12 and the foreign-matter collecting roller 91 is −500, −700, −1000, and −1500 (V/m) Incidentally, the potential between the photoconductor drum 12 and the non-printed area NPA is −550 V, and the distance between the photoconductor drum 12 and the foreign-matter collecting roller 91. Accordingly, when the intensity of the electric field is set to −1500 V/m, setting is performed such that a collection bias of −1500×0.5−550=−1300 V is applied to the foreign-matter collecting roller 91 by the foreign-matter collection bias power 92.

Figure 10:
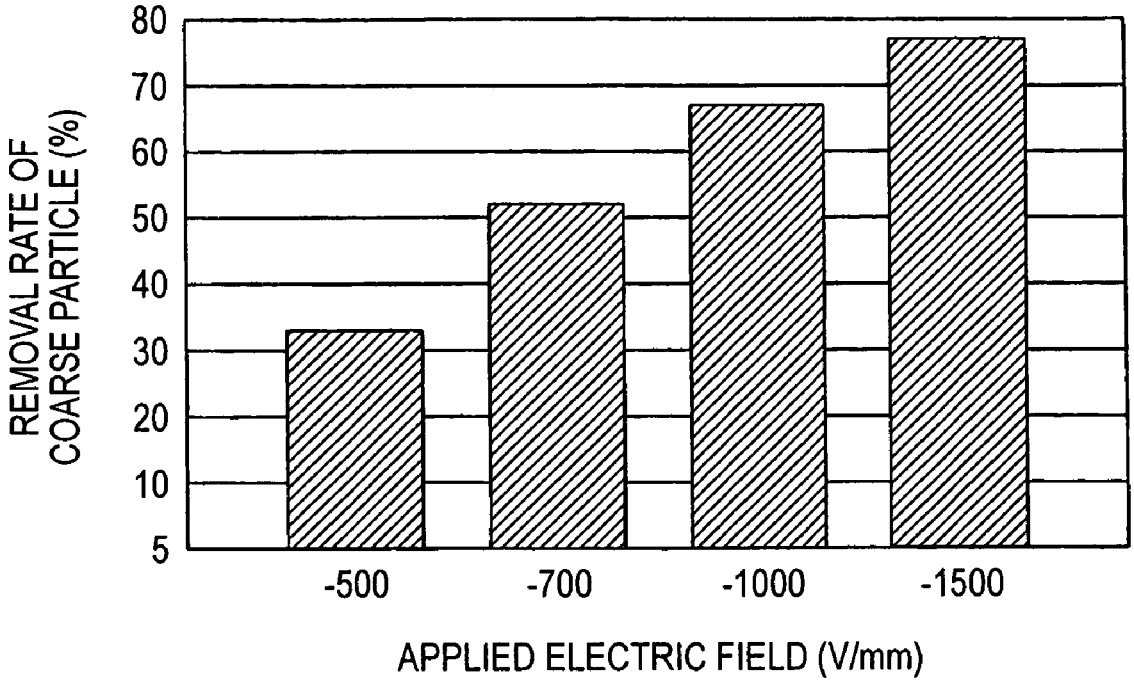
FIG. 10 is a graph showing the relationship between an applied voltage formed between a foreign-matter collecting roller and a photoconductor drum, and the removal rate of defect caused by coarse debris on the photoconductor drum.

FIG. 10 is a graph showing the results of the experiment, i.e., the relationship between an applied voltage formed and the removal rate of coarse particle defect. It can be understood from FIG. 10 that the higher the applied magnetic field is, the higher the removal rate of coarse particle defect is. In particular, if the applied voltage is above −700 v/m, it was proved that that the removal rate of coarse particle defect above 50% can be ensured. If the applied voltage is increased, the probability increases that the paper debris PD and the aggregated cleaning agent GA each having positively charged polarity can be transferred to the foreign-matter collecting roller 91. As a result, in the non-printed area NPA, it is considered that the toner T attached to the paper debris PD or the aggregated cleaning agent GA was also transferred to the foreign-matter collecting roller 91.

EXAMPLE 1

The inventors carried out evaluation of the relationship between the amount of wear of the organic conductive layer 12*a* and black points (aggregate defect) caused by the aggregated cleaning agent GA while changing the intensity of an applied electric field formed between the photoconductor drum 12 and the foreign-matter collecting roller 91 by using a developer D to which the cleaning agent A (hereinafter referred to as Sample 1) and a developer D (hereinafter referred to as Sample 2) to which the cleaning agent A is not applied. In Example 1, as an image forming apparatus, a remodeled machine of the Monochro Complex Machine DC 402 made by Fuji Xerox Co., Ltd. was used. Incidentally, DC 402 is an image forming apparatus of a type that directly transfers a toner image formed on the photoconductor drum 12 to a recording paper P. As for the image forming apparatus, remodeling of returning the toner T removed by the drum cleaner 16 to the developing device 14, and remodeling of attaching the foreign-matter collecting mechanism 90 was carried out.

Further, a developer D obtained by a manufacturing method described in Japanese Patent No. 3141783 was used as the toner T to be contained in the developer D. Also, as the cleaning agent A, Sample 1 was obtained by mixing zinc stearate in a ratio of 0.5 weight % to the weight of toner and by adding carrier C to the mixture. Incidentally, Sample 2 was obtained by adding cleaning agent A to the above-described toner T without containing zinc stearate (cleaning agent A).

Then, the gap between the photoconductor drum 12 and the foreign-matter collecting roller 91 was set to be 0.5 mm, and 100,000 times of printing were carried out in a print ratio of 10% by use of Sample 1 under the following respective conditions: an applied voltage of 500 V/m, −700 V/m and −1000 V/m, by application of a bias or by no application of a bias.

Figure 11:
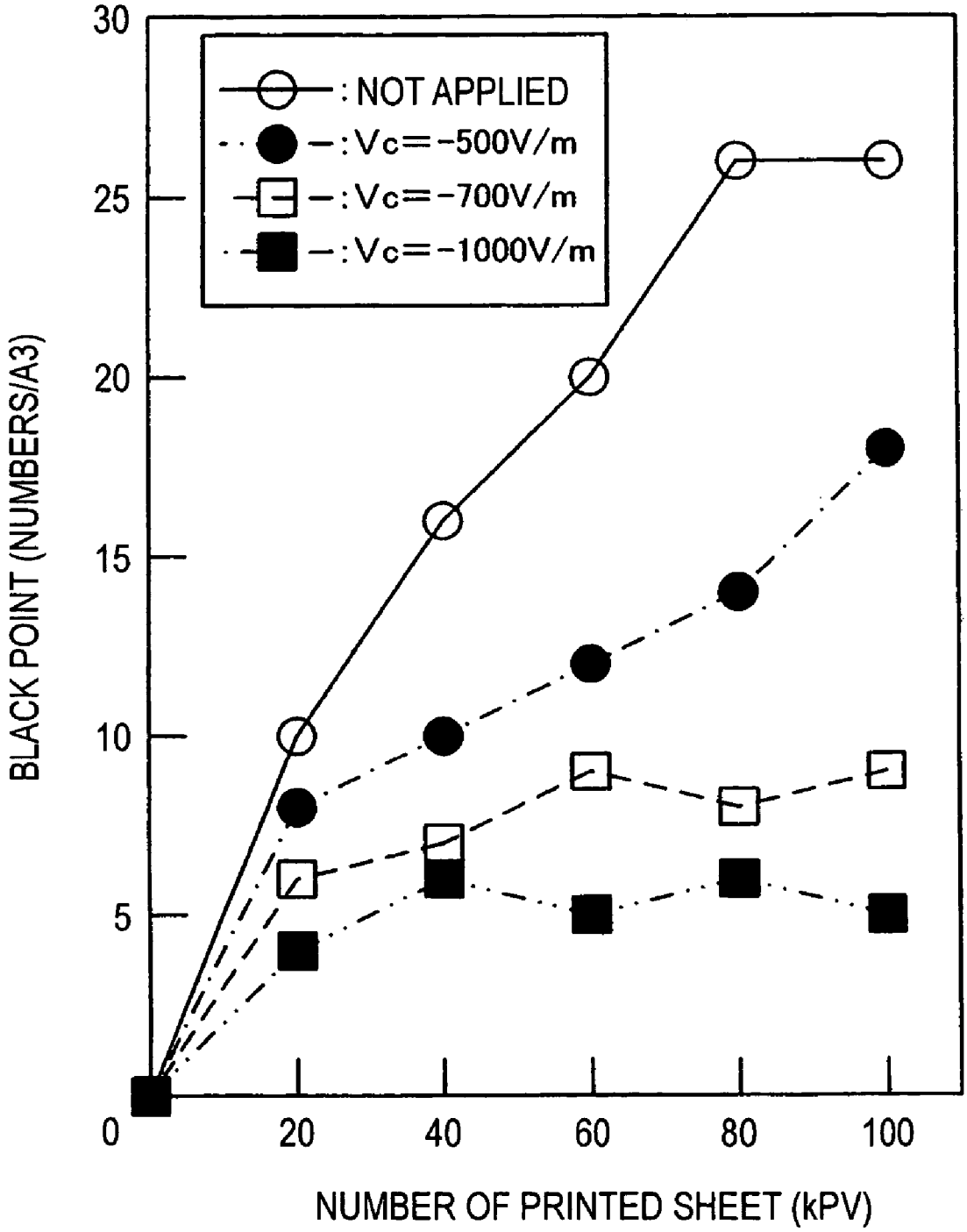
FIG. 11 is a graph showing the number of printed sheets and the number of black points when a foreign matter collection bias is adopted as a parameter.

FIG. 11 is a graph showing results when Sample 1 was used as the developer D. Incidentally, in FIG. 11, the abscissa represents the number of printed sheets, and the ordinate represents the number of black points generated on an A3-size sheet (the aggregate defect caused by the toner T attached to the aggregated cleaning agent GA transferred to the non-printed area NPA on the photoconductor drum 12). In case of no application of a bias, the defects (black points) caused by aggregated cleaning agent GA after 20,000 sheets exceeds 10/A3 as a target value, whereas the defects was within a target value even after completion of printing of 100,000 sheets under the conditions, −700 V/m and −1000 V/m. Further, the amount (residual amount) of wear of the organic conductive layer 12*a* after printing of 100,000 sheets is 15 μm (residual amount 17 μm), which did not exceed the use limit (more than 15 μm).

On the other hand, when Sample 2 was used as the developer D under the condition, an applied voltage of −700 V/m, the aggregated cleaning agent GA is not generated. Thus, the number of black points satisfies 10/A3, i.e., a target value, even after printing of 100,000 sheets. However, after printing of 70,000 sheets, fogging was caused due to excess of a wear limit of the organic conductive layer 12*a*.

EXAMPLE 2

Next, the inventors carried out evaluation similar to Example 1 by using the printer 1 (a remodeled machine of Full-Color Printer C3530 made by Fuji Xerox Co., Ltd.) used as an image forming apparatus in the present embodiment. Bias was applied so that the applied electric force becomes −700 V/m, and printing of 100,000 sheets was performed using Sample 1 as the developer D. As a result, the number of black points after completion of printing of 100,000 is below 10/A3, which were good results. Also, the amount of wear the organic conductive layer 12*a* after the completion of printing of 100,000 is 15 μm (residual amount of 17 μm), which did not exceed the use limit (more than 15 μm).

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent-image carrier;

a developing unit that carries a developer containing a toner and develops an electrostatic latent image on the latent-image carrier with the toner;

a transfer unit that transfers the toner developed on the latent-image carrier by the developing unit to a recording material directly or via an intermediate transfer body;

a cleaning unit that removes a toner remaining on at least one of the latent-image carrier and the intermediate transfer medium after the transfer;

a recovered-toner supply unit that supplies a toner removed by the cleaning unit to the developing unit again; and a foreign-matter collecting unit that collects a foreign matter, which is mixed into the toner supplied from the recovered-toner supply unit and moved onto the latent-image carrier by the developing unit, before the transfer by the transfer unit.

2. The image forming apparatus according to claim 1, wherein the foreign-matter collecting unit collects the foreign matter charged to a polarity reverse to a charged polarity of the toner.

3. The image forming apparatus according to claim 1, wherein:

the recording material is paper, and the foreign matter is paper debris moved from the paper to at least one of the latent-image carrier and the intermediate transfer medium.

4. The image forming apparatus according to claim 1, wherein the developer further contains a lubricant for suppressing wear of the latent-image carrier.

5. The image forming apparatus according to claim 4, wherein the lubricant has a charged polarity reverse to that of the toner.

6. The image forming apparatus according to claim 4, wherein the foreign matter is an aggregate of the lubricant.

7. The image forming apparatus according to claim 1, wherein the cleaning unit comprises a cleaning blade coming into pressure contact with at least one of the latent-image carrier and the intermediate transfer medium.

8. An image forming apparatus comprising:

an image carrier that is rotatably disposed to carry an electrostatic latent image including a printed area and a non-printed area;

a developing section that develops the printed area of the electrostatic latent image carried on the image carrier with a toner;

a transfer section that transfers the toner developed on the image carrier by the developing section to a transfer material;

a cleaning section that removes the toner remaining on the image carrier after transferring the toner by the transfer section;

a recovered-toner supply section that supplies the toner removed by the cleaning section to the developing section again;

a facing member that is disposed on downstream of the developing section in a rotation direction of the image carrier and on upstream of the transfer section in the rotation direction of the image carrier to face the image carrier in non-contact therewith; and a bias-applying section that applies a bias for forming an electric field between the image carrier and the facing member, wherein the electric field moves a foreign matter attached to the non-printed area of the electrostatic latent image on the image carrier to the facing member.

9. The image forming apparatus according to claim 8, wherein the facing member is a rotatable roller member, the image forming apparatus further comprising a cleaning member that is in contact with the roller member to clean a surface of the roller member.

10. The image forming apparatus according to claim 8, wherein the developing section develops the printed area of the electrostatic latent image with a developer containing a lubricant for suppressing wear of the toner and the image carrier.

11. The image forming apparatus according to claim 8, wherein the toner and the lubricant have charged polarities different from each other.

12. An image forming apparatus comprising:

a black-image forming unit that forms a black toner image;

at least one color-image forming unit that forms a color toner image other than the black toner image;

an intermediate transfer body that circulates between a position facing the black-image forming unit and a position facing the color-image forming unit, the toner image formed by the black-image forming unit and/or the color-image forming unit primarily transferred onto the intermediate transfer body;

a secondary transfer section that secondarily transfers the toner images primarily transferred onto the intermediate transfer medium onto a recording material; and an intermediate-transfer cleaning section that removes a toner remaining on the intermediate transfer body after the secondary transfer, wherein:

each of the black-image forming unit and the color-image forming unit comprises:

an image carrier that is rotatably disposed to carry an electrostatic latent image;

a developing section that develops the electrostatic latent image carried on the image carrier with the toner of a corresponding color; and a primary transfer section that transfers the toner developed on the image carrier by the developing section onto the intermediate transfer body, the developing section of the black-image forming unit is supplied with the toner removed by the intermediate-transfer cleaning section, and the black-image forming unit further comprises a foreign-matter collecting section that collects a foreign matter, which is mixed into the toner to be supplied to the developing section via the intermediate-transfer cleaning section and moved to the image carrier from the developing section, before the transfer by the primary transfer section.

13. The image forming apparatus according to claim 12, wherein the foreign-matter collecting section comprises a collecting member facing the image carrier of the black-image forming unit to be in non-contact with the image carrier of the black-image forming unit, a predetermined collection bias being applied to the collecting member.

14. The image forming apparatus according to claim 12, wherein each of the black-image forming unit and the color-image forming unit further comprises:

an image-carrying cleaning section that removes the toner remaining on the image carrier after the primary transfer by the primary transfer section; and a recovered-toner supply section that supplies the toner removed by the image-carrier cleaning section to the developing section of the corresponding image forming unit again.

15. The image forming apparatus according to claim 14, wherein the black-image forming unit is disposed on downstream of the color-image forming unit in a moving direction of the intermediate transfer body and on upstream of the secondary transfer section in the moving direction of the intermediate transfer body.

* * * * *